US005836708A

United States Patent [19]

Tani

[11] Patent Number: 5,836,708

[45] Date of Patent: Nov. 17, 1998

[54] CARTRIDGE-TYPE FEEDING CASE FOR A SOLID OBJECT

[75] Inventor: Yoshikazu Tani, Tokyo, Japan

[73] Assignee: Tokiwa Corporation, Nakatsugawa, Japan

[21] Appl. No.: 652,119

[22] Filed: May 23, 1996

Related U.S. Application Data

[63] Continuation of Ser. No. 166,448, Dec. 13, 1993, abandoned.

[30] Foreign Application Priority Data

Sep. 8, 1993 [JP] Japan ..... 5-048888 U
Sep. 8, 1993 [JP] Japan ..... 5-048889 U

[51] Int. Cl.[6] ..... A45D 40/06; A45D 40/12

[52] U.S. Cl. ..... 401/70; 401/75; 401/76; 401/172; 401/194

[58] Field of Search ..... 401/70, 75, 76, 401/79, 80, 173, 172, 174, 175, 194

[56] References Cited

U.S. PATENT DOCUMENTS

| | | | |
|---|---|---|---|
| 1,458,281 | 6/1923 | Everett | 401/75 X |
| 2,168,877 | 8/1939 | Noyack et al. . | |
| 2,395,710 | 2/1946 | Anderson . | |
| 2,506,984 | 5/1950 | Anderson . | |
| 2,789,692 | 4/1957 | Ferri . | |
| 2,839,029 | 6/1958 | Melnikoff | 401/75 |
| 3,132,743 | 5/1964 | Wolff . | |
| 3,230,960 | 1/1966 | Moore et al. . | |
| 3,393,036 | 7/1968 | Fuglsang Madsen . | |
| 3,511,575 | 5/1970 | Berins . | |
| 3,995,648 | 12/1976 | Kuryla | 401/173 |
| 4,180,163 | 12/1979 | Grioni | 206/385 |
| 4,770,556 | 9/1988 | Ackermann et al. | 401/69 |
| 4,813,801 | 3/1989 | Cardia | 401/71 |
| 4,961,663 | 10/1990 | Iwamoto et al. | 401/78 |
| 4,997,299 | 3/1991 | Ohba | 401/75 |
| 5,009,534 | 4/1991 | Gueret | 401/75 |
| 5,172,993 | 12/1992 | Ackermann et al. | 401/69 |
| 5,230,577 | 7/1993 | Cox et al. | 401/68 |
| 5,348,410 | 9/1994 | Shozi et al. | 401/78 |
| 5,423,623 | 6/1995 | Bakic | 401/70 |
| 5,547,302 | 8/1996 | Dornbusch et al. | 401/172 |

FOREIGN PATENT DOCUMENTS

| | | | |
|---|---|---|---|
| 3728427 | 12/1988 | Germany | 401/75 |
| 4340067 | 5/1994 | Germany . | |
| 56-14726 | 7/1981 | Japan . | |
| 58-9535 | 2/1983 | Japan . | |
| 62-32483 | 8/1987 | Japan . | |
| 1-11137 | 3/1989 | Japan . | |
| 2-38669 | 10/1990 | Japan . | |
| 2-40898 | 10/1990 | Japan . | |
| 3-25705 | 6/1991 | Japan . | |
| 3-31232 | 7/1991 | Japan . | |
| 4-03618 | 1/1992 | Japan . | |
| 6181813 | 7/1994 | Japan . | |
| 9208387 | 5/1992 | WIPO . | |

*Primary Examiner*—Steven A. Bratlie
*Attorney, Agent, or Firm*—Greer, Burns & Crain, Ltd.

[57] ABSTRACT

The cartridge C and the case body 10 relatively rotate to rotate the extruding rod 13 by engaging the rotary driving hole 24*a* to the shaft 14. The extruding rod 13 moves back and forward against the exterior case 11 of the case body 10 along an axial direction of the extruding rod 13. The tip end of the shaft 14 of the extruding rod 13 pushes the core chuck 21 against the spring 25 in the cartridge body 20 by back and forward movement of the extruding rod 13. Therefore, a stick-type solid cosmetic 22 held by the core chuck is fed from the tip opening of the cartridge body 20. The extruding rod 13 has applied thereto slide resistance by an elastic ring 39 positioned in the case body 10 and through which this rod extends in friction relationship.

26 Claims, 18 Drawing Sheets

CARTRIDGE-TYPE FEEDING CASE FOR A SOLID OBJECT

This application is a continuation of application Ser. No. 08/166,448, filed Dec. 13, 1993, now abandoned.

BACKGROUND OF THE INVENTION

1. Field of the Invention

The present invention relates to a feeding case for feeding a stick type solid object from a cartridge, in particular, to a feeding case provided with a cartridge accommodating a stick type solid cosmetic, for feeding the stick type solid cosmetic to project it outside the cartridge.

2. Description of the Related Art

A conventional feeding case has a case body and a removable cartridge installed to the case body for feeding a stick type solid object, for example, a solid cosmetic to project it outside the cartridge. FIG. 31 shows a feeding case disclosed in Japanese Utility Model publication Kokoku No. 2-38669 proposed by the inventor As disclosed in the Utility model publication, one of the basic structures of feeding cases is a cylindrical case body 1 and a cartridge 2 projectably holding a stick type solid cosmetic 3 at the inside thereof. The cartridge 2 can be installed in and removed from the cylindrical case body 1. In the cartridge 2, the solid cosmetic 3 is fixed to a core chuck 4 as a retainer. The core chuck 4 is held in the cartridge 2 to move back and forward along the axial direction of the cartridge 2.

A rear end of the cartridge 2 is shut by a rear plug 7. The rear plug 7 has an annular engage groove 7*a* around a peripheral surface thereof. The rear plug 7 has an opening formed in an axis thereof. The opening is provided with a non-circular shaped groove 7*b* such as a sprocket, a serration or the like.

A compression coil spring 8 is installed between the fore-end of the inside of the cartridge and the core chuck 4 as a retainer to urge the core chuck 4 usually toward a proximal end. When the core chuck 4 is pushed out toward a distal end against the urging force of the coil spring 8, the solid cosmetic 3 held by the core chuck 4 protrudes from the cartridge 2. After using the solid cosmetic 3, the solid cosmetic 3 is accommodated in the cartridge 2 because of spring force of the coil spring 8.

The description will now be made as regards a case of the structure of the case body 1. The case body 1 is provided with a plug 6 at an opening end thereof. The plug 6 is used for detaining the cartridge 2 on a predetermined position. The plug 6 is engaged in an inner surface of the opening end of the case body 1. Accordingly, the cartridge 2 is installed in or removed from the case body 1 via the plug 6. The plug 6 is provided with a restriction rib 6*a* having an annular convex shape on an inner surface at the rear end of the plug 6. The restriction rib 6*a* engages an annular concave groove 7*a* formed on the surface of the rear plug 7 disposed at the rear end of the cartridge 2. Therefore, the cartridge 2 is capable of being rotatably supported in the plug 6 and not capable of sliding along an axial direction of the plug 6.

A rod retainer 9 is coaxially held in the inner part of the case body 1. The rod retainer 9 has a retaining hole 9*c* for retaining an extruding rod 5 at a central axis portion of the rod retainer 9. On an inner surface of the retaining hole 9*c*, a helicoidal surface 9*a* having a shape of a female screw is formed except for the stopper 9*b* at the distal end.

The extruding rod 5 is held in the retaining hole 9*c*. The extruding rod 5 has an outer diameter which is slightly smaller than an inner diameter of the retaining hole 9*c*, namely, an inner diameter of the stopper 9*b*. A helicoidal protruding portion 5*a* having the shape of a male screw is formed on the outer surface of the extruding rod 5 and is threadedly engaged with the helicoidal surface 9*a*. Therefore, the rod retainer 9 and the extruding rod 5 are relatively rotated as helicoidal movement whereby the extruding rod 5 moves back and forward along the axial direction thereof. An outer diameter of the helicoidal protruding portion 5*a* is larger than an inner diameter of the stopper 9*b*. Accordingly, the helicoidal protruding portion 5*a* contacts the stopper 9*b* to prevent the extruding rod 5 from extruding furthermore. The cross section of the extruding rod 5 is similar to the cross-section of the non-circular opening, of the rear plug 7. Therefore, the cartridge 2 and the extruding rod 5 are not capable of mutually rotating and are capable of moving back and forward along the axial direction of the cartridge 2 to be supported by each other.

The description will now be made as regards a case of operation of the conventional feeding case. The cartridge 2 is installed in the case body 1 by inserting the extruding rod 5 into the opening of the rear plug 7, then the cartridge 2 is relatively rotated against the case body 1. The rotation of the cartridge 2 is transmitted to the extruding rod 5. Thereby, the extruding rod 5 is rotated relative to the case body 1 (namely, relative to the rod retainer 9). Consequently, the extruding rod 5 is moved back and forward along the axial direction relative to the case body 1 by helicoidal movement. In this event, the rear plug 7 is engaged with the extruding rod 5 to be moved back and forward along the axial direction of the extruding rod 5 and is engaged with the plug 6 not to be moved back and forward along the axial direction of the plug 6. Therefore, it is impossible for the extruding rod 5 to move the cartridge 2 relative to the case body 1 along the axial direction of the cartridge 2.

When the extruding rod 5 is moved toward the distal end, namely, toward the core chuck 4, a tip of the extruding rod 5 contacts the proximal end of the core chuck 4. When the extruding rod 5 is then moved toward the core chuck 4 furthermore, the core chuck 4 is extruded against the spring force by the compression coil spring 8. At the same time, the solid cosmetic 3 is protruded from an opening at a tip of the cartridge 2. A user adjustably rotates the feeding case for the cartridge 2 to project the solid cosmetic with a suitable length thereof. Then the solid cosmetic 3 is used.

After using of the solid cosmetic 3, the remainder protruded necessarily of the solid cosmetic 3 is necessarily accommodated into the cartridge 2. When the cartridge 2 is conversely rotated relative to the case body 1 contrary to the above mentioned, the extruding rod 5 moves back toward the proximal end. According to the movement of the extruding rod 5, the core chuck 4 moves toward the proximal end by spring force of the compression coil spring 8. The solid cosmetic 3 is thereby retracted in the cartridge 2.

In accordance with increase of a consumed amount of the solid cosmetic, an extruding amount of the extruding rod 5 is increased. However, a moving stroke, i.e. the maximum extruding amount of the extruding rod 5, is limited by contacting the helicoidal protruding portion 5*a* with stopper 9*b*. Therefore, the extruding rod 5 is prevented from being extruded furthermore.

There are following a number of problems to be solved for the conventional cartridge-type feeding case for feeding the solid object having the structure mentioned above.

The first problem of the conventional feeding case that the extruding rod 5 is retracted all at once into the case body by the spring force of the compression coil spring 8 when the cartridge is rotated in the counter direction to retract the solid cosmetic and that the extruding rod is retracted too much when the projecting amount of the cosmetic is precisely adjusted. In condition of moving the extruding rod 5 in a protruding direction thereof, the spring force of the compression coil spring 8 is applied through the core chuck 4 to the extruding rod 5 as a repelling force to move the extruding rod 5 back. A partial force having a predetermined rate is defined by a lead of the helicoidal protruding portion 5*a* and helicoidal surface 9*a*. The partial force is converted into rotating force by the helicoidal protruding portion 5*a* and helicoidal surface 9*a* to rotate the extruding rod 5 and cartridge 2. When the rotating force exceeds the torque of the extruding rod 5 and the cartridge 2, the extruding rod 5 rotates and retracts into the case body 1 at the same time.

The second problem is that such a feeding case is easily broken because of overstrain produced in the internal structure of the case body. When the helicoidal protruding portion 5*a* of the extruding rod 5 contacts the stopper 9*b* to prevent the extruding rod 5 from moving forward, it creates a condition in which the core chuck 4 has reached the distal end in the cartridge 2. The condition means that the solid cosmetic is consumed to be the shortest length thereof. Actually, when the user rotates the cartridge 2 to protrude the solid cosmetic 3, and the helicoidal protruding portion 5*a* contacts the stopper 9*b* not to protrude the protruding portion 5*a* furthermore, at that moment, the relative rotation of the cartridge 2 and the case body 1 applies a strong force responsive to the contact. Thereby, the torque applied to the cartridge 2 increases suddenly. Therefore, it is possible for the user to understand that the solid cosmetic 3 is completely consumed through awareness of the increasing torque. However, the internal elements including the helicoidal protruding portion 5*a* and stopper 9*b* which are directly impacted by contacting each other are overstrained, so that the overstrain brakes the feeding case rendering it not reusable.

The third problem that such feeding case has a large number of the parts. The conventional cartridge-type feeding case mentioned above is provided with the stopper 9*b* for controlling the stroke of the extruding rod 5, and the plug 6 for holding the cartridge 2 rotatably and non-movably along the axial direction of the cartridge 2. The stopper 1*b* and the plug 6 are disposed in the case body 1 as independent parts, respectively. Therefore, it is a problem that the number of parts are increased in the case body, thereby the construction becomes complicated and the number of product steps are increased.

SUMMARY OF THE INVENTION

It is therefore an object of the present invention to provide a cartridge-type feeding case for preventing a stick type solid object from retracting against the user's will and for providing a better operational feed.

It is another object of the present invention to provide a cartridge-type feeding case for making the user recognize that a solid cosmetic is completely consumed and for preventing the internal elements of the case body from damage by overstraining feeding rotation.

It is still another object of the present invention to provide a cartridge-type feeding case for decreasing the number of the parts and the product steps.

In accordance with the present invention, there is provided a cartridge-type feeding case for feeding solid cosmetic comprising a cartridge for projectably accommodating the solid object into a through hole in said cartridge, and a case body for removably and rotatably holding the cartridge, comprising: an extruding rod integrated in said case body for extruding said solid object when the cartridge is installed to said case body, said extruding rod being allowed to move back and forward in said case body, converting means for converting rotation movement into relative sliding movement relative to said case body, said rotation movement being produced by rotating said cartridge relative to said case body and, resistance means for applying slide resistance concerning back and forward movement of said extruding rod relative to said case body. Furthermore, the present invention provides a cartridge-type feeding case comprising a cartridge for projectably accommodating the solid object into an internal through hole and a case body having an opening for removably holding the cartridge, comprising: a plug disposed to the opening of said case body, said plug for rotatably holding said cartridge, said cartridge being barred from moving back and forward along an axial direction; an extruding rod installed in said case body for extruding said solid object when the cartridge is installed in said case body, the extruding rod being allowed to move back and forward in said case body, the extruding rod comprising a stick-type shaft and a large diameter part having a diameter larger than said stick-type shaft; a converting means for converting rotation movement into sliding movement relative to said case body, where the rotation movement is produced by relatively rotating said cartridge relative to said case body, and a stopper for having an opening to insert said shaft and not to insert said large diameter part and for defining the maximum movement point toward said cartridge by said extruding rod. The present invention provides a cartridge-type feeding case for feeding the solid cosmetic comprising a cartridge for projectably accommodating the solid object into an internal through hole and a case body having an opening for removably and rotatably holding the cartridge, comprising: an extruding rod installed in said case body for extruding said solid object when the cartridge is installed in said case body, the extruding rod being allowed to move back and forward in said case body; a converting means for converting rotation movement into a sliding movement relative to said case body, the rotation movement being produced by rotating said cartridge relative to said case body; and, a canceling means for canceling the conversion by said converting means at the maximum moving position toward said cartridge by said extruding rod.

As described hereinafter, the present invention can be practiced in various kinds of form. For example, the solid object may be a cosmetic, an eraser, or a lead of a mechanical pencil. The cartridge may movably hold the solid object directly or may hold the solid object indirectly by the retainer. The cartridge may be connected to the case body directly or may be connected to the case body by a separate plug. The structure of the converting means may be used with a screw, a gear, for example, a rack and a pinion or worm gear, or a cam. In the case of using a screw, the screw may be disposed between the extruding rod and the case body to transport the rotation of the cartridge to the extruding rod to move the extruding rod back and forward by rotating it relative to the case body. In this case, the extruding rod does not rotate with the cartridge mutually. Alternatively, the screw may be disposed between the extruding rod and the cartridge to move the extruding rod by the rotation of the cartridge with no rotation of the extruding rod relative to the case body. For defining the extent of movement of the extruding rod, a stopper may be disposed for preventing the extruding rod from moving over the extent of movement or the converting means may cancel converting of the driving force for preventing the extruding rod from moving over the extent of movement. Furthermore, for letting the user know that the extruding rod has come to the movement limit, the operational feel may change when the extruding rod has come to the limit. The stopper may define the movement of the extruding rod by running up to the large diameter part of the extruding rod. In this case, the stopper may be a ring member through which the extruding rod is inserted, or an arm member having no ring form. The stopper may be integrated with the plug or may be structured as a separate member with the plug. The resistance means may be constructed by pressing an elastomer member like a rubber to the extruding rod. In this case, the elastomer member may be an elastomer ring installed to the extruding rod. Alternatively, the resistance means may be a construction increasing the coefficient of friction by matte finishing or knurling a surface of the extruding rod or canceling the knurl.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

First Embodiment

Figure 1:
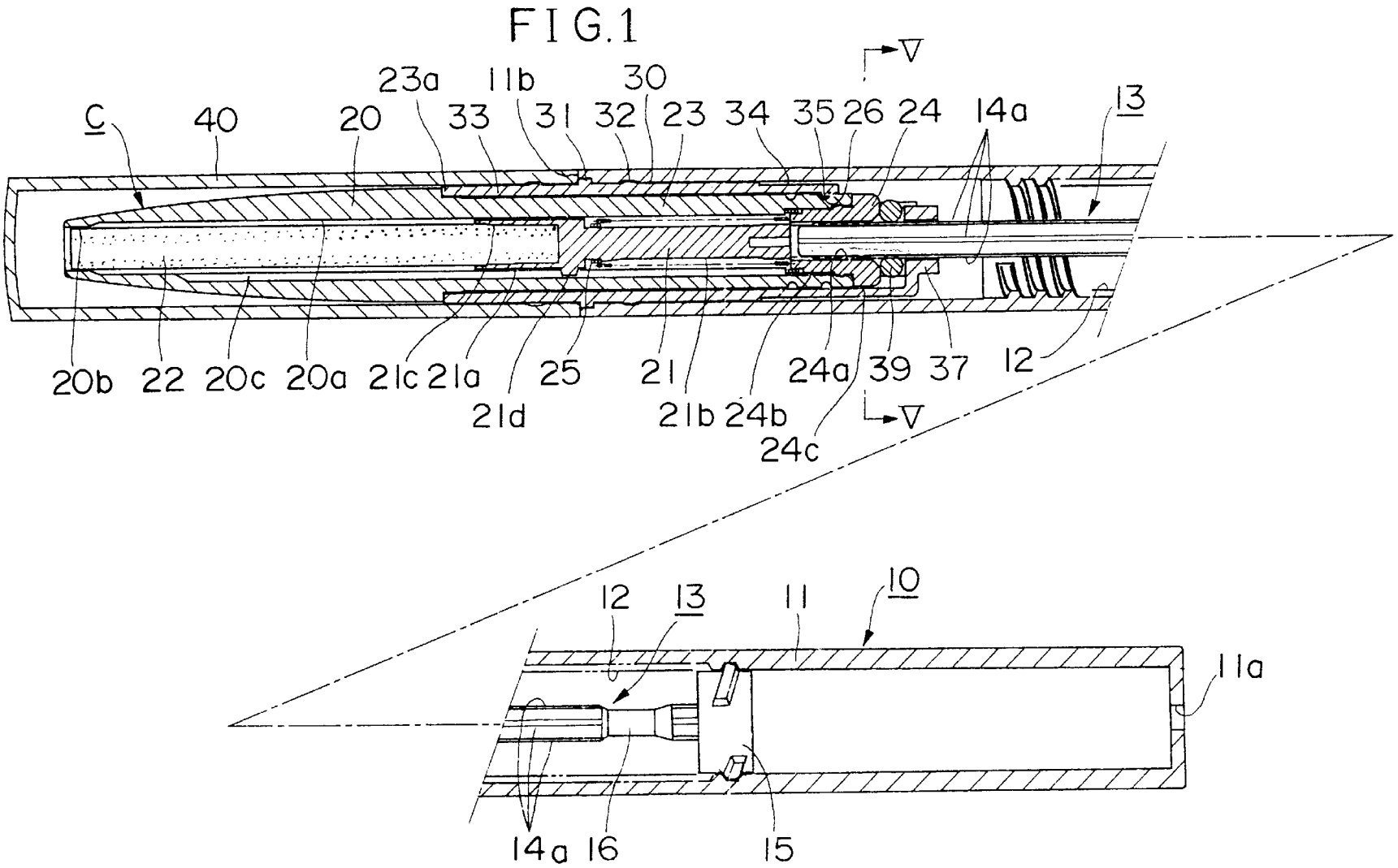
FIG. 1 is a vertical section of a cartridge-type feeding case for feeding a solid object according to a first embodiment of the present invention, in which the solid object is installed.

Referring to FIG. 1, which shows an apparatus according to a first embodiment of the present invention, a feeding case has a cylindrical case body 10 and a cartridge C. The cartridge C is removably connected to the cylindrical case body 10 at the distal end side of the cylindrical case body 10.

Figure 3:
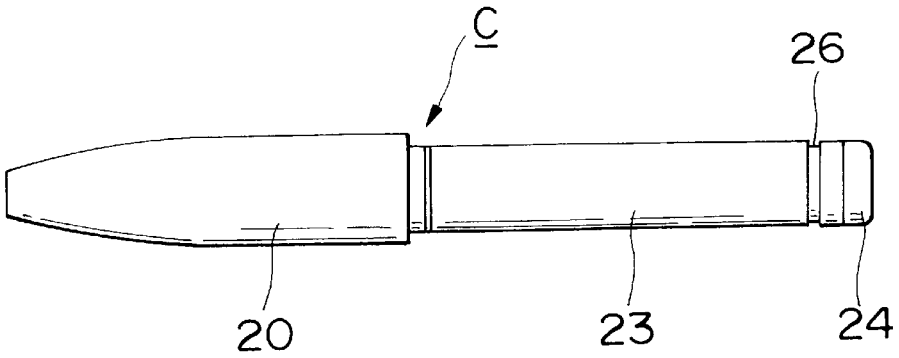
FIG. 3 is a side view of a cartridge C used in each embodiment of the present invention.

An outside appearance of a side surface of the cartridge C is shown in FIG. 3. As shown in FIGS. 1 and 3, a cartridge body 20 is a main part of the cartridge C and has an outer surface having a shape of a taper at a distal end. The cartridge body 20 has a cylindrical inserting portion 23 at a proximal end. The cylindrical inserting portion 23 has an outer diameter at the proximal end smaller than an outer diameter at the distal end. An annular engage groove 26 is formed around the proximal end of the cylindrical inserting portion 23.

The cartridge body 20 has a through hole 20*a* in a central axis thereof. The through hole 20*a* has a small diameter part 20*b* at a tip thereof. The small diameter part 20*b* has an inner diameter slightly smaller than the other parts. The through hole 20*a* has a plurality of straight grooves 20*c* along an axial direction at a plurality of portions disposed toward a circumference of an inner surface of the through hole 20*a*.

A core chuck 21 is slidably disposed to the through hole 20*a* of the cartridge C. The core chuck 21 comprises a large diameter part 21*a* at a tip end thereof and a small diameter part 21*b* at a rear end thereof. The large diameter part 21*a* has an outer diameter which is about the same as an inner diameter of the through hole 20*a*. Therefore, the core chuck 21 is held in the through hole 20*a* without shaking. Furthermore, the large diameter part 21*a* has a pin 21*d* disposed to an outer surface thereof to slidably engage the straight groove 20*c*. Therefore, the core chuck 21 is restricted to rotate relative to the cartridge body 20. The large diameter part 21*a* has a retaining hole 21*c* for retaining a solid cosmetic 22 as a solid object in the retaining hole 21*c*.

The solid cosmetic 22 may be a stick type cosmetic such as an eye liner. The solid cosmetic 22 has a outer diameter slightly smaller than the small diameter part 20*b* of the through hole 20*a*. Accordingly, even if a tip of the solid cosmetic 22 is protruded from the cartridge body 20, the protruded portion of the solid cosmetic 22 is supported by the small diameter part 20*b*. Therefore, it is possible to prevent the solid cosmetic 22 from deflection and breaking. Furthermore, the solid cosmetic 22 is prevented from being caught by the small diameter part 20*b* when the solid cosmetic 22 is drawn into the cartridge body 20.

A rear plug 24 has a small outer diameter part 24*b* which is inserted in a proximal end opening of the through hole 20*a* to shut the opening by the small outer diameter part 24*b*. The rear plug 24 has a largest outer diameter part 24*c* having the same size as the outer diameter of the inserting portion 23. The rear plug 24 has a rotary driving hole 24*a* formed in a central axis thereof. The rotary driving hole 24*a* has a non circular section thereof.

The rear plug 24 and the core chuck 21 have an extension spring 25 such as a coil spring therebetween. In other words, the extension spring 25 is disposed in a clearance between the through hole 20*a* and the small diameter part 21*b* of the core chuck 21. The extension spring 25 has a tip end fixed around a step portion of the core chuck 21 and a rear end fixed around a tip of the rear plug 24. Therefore, the solid cosmetic 3 retained by the core chuck 4 is protruded from the cartridge C by pushing the core chuck 4 toward the distal end against the urging force of the extension spring 25.

After using it, the solid cosmetic 3 is drawn and accommodated in the cartridge C with the core chuck 4 because of the spring force of the coil spring 25.

The description will now be made as regards the structure of the case body 10. The case body 10 has an exterior cylinder 11 which has a cylindrical shape with a bottom. The exterior cylinder 11 has a baseplate 11*a* having a small hole. The small hole was formed by a guide which was used for supporting a core pin during molding of the cylinder. A helicoidal groove 12 having a shape of a female screw thread is formed at a middle portion of an inner surface of the exterior cylinder 11 with an appropriate range. In this event, the exterior cylinder 11 has a small inner diameter part between the helicoidal groove 12 and a proximal end of the exterior cylinder 11 and a large inner diameter part between the helicoidal groove 12 and a distal end of the exterior cylinder 11. The small inner diameter part has the same size as a diameter of the top of the helicoidal groove 12. The large inner diameter part has the same size as a diameter of the bottom of the helicoidal groove 12.

Figure 6:
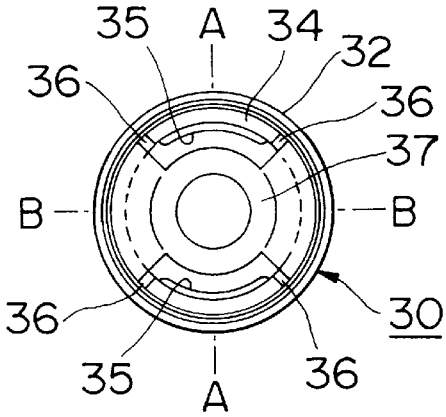
FIG. 6 is a rear view of a plug 30 of FIG. 1 from the proximal end side of the cartridge-type feeding case.
Figure 7:
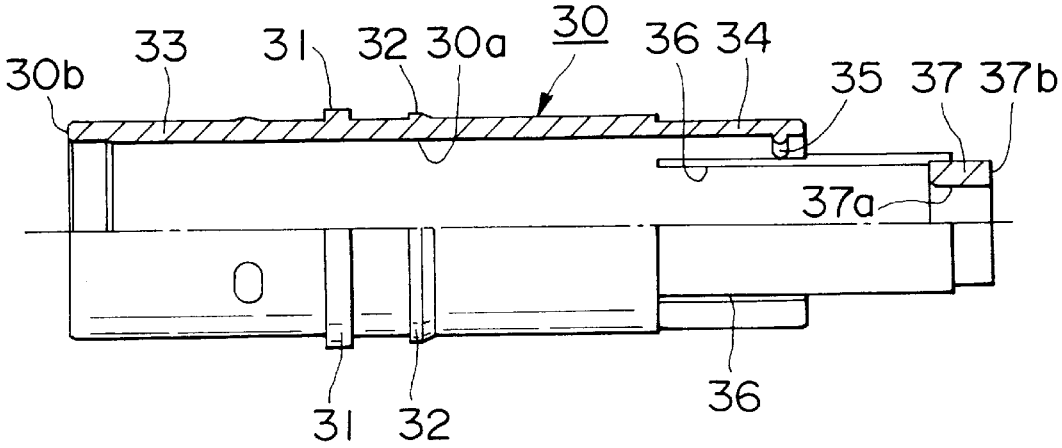
FIG. 7 is a semi vertical section of the plug 30 shown in FIG. 6 taken on a line A—A and from a direction B.
Figure 8:
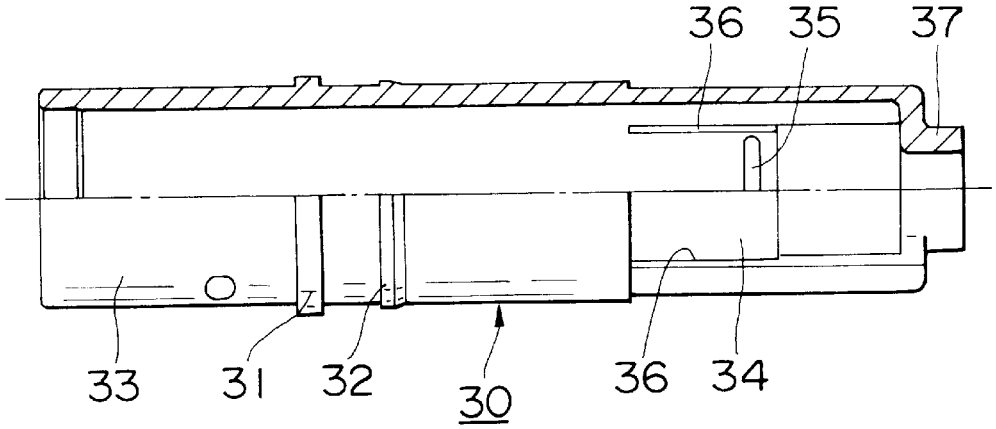
FIG. 8 is a semi side view of the plug 30 shown in FIG. 6 taken on a line B—B and from a direction A.

A plug 30 is disposed within a tip opening 11*b* of the exterior cylinder 11 and mediates between the cartridge C and the case body 10. The structure of the plug 30 is shown in FIG. 6~FIG. 8. As shown in these figures, the plug 30 has substantially a cylindrical shape on the whole. An outer diameter of the plug 30 has the same size or is slightly larger than the inner diameter of the exterior cylinder 11. Therefore, the plug 30 is interference fitted to the exterior cylinder 11 of the case body 10 by inserting the proximal end of plug 30 into the tip opening of the exterior cylinder the case body 10. To ensure of fixation, and to prevent further inserting annular undercut protruding portions 31 and 32 are formed around a central portion of an outer surface of the plug 30. The annular undercut protruding portions 31 and 32 are engaged to the tip opening 11*b* of the exterior cylinder 11, dropping in the annular, undercut groove portion inside the opening 11.

The tip part of the plug 30 which leaves the undercut 31 and 32 is a cap applied portion 33 which is exposed outside the tip opening of the exterior cylinder 11. An outer surface of the cap applied portion 33 is detachably covered by a cap 40 to cover the cartridge C.

An inserting portion 23 which is formed as a stepped thin portion at a rear side of the cartridge body 20 is smoothly inserted into an inner surface 30*a* of the plug 30 to be detached. The inserting portion 23 is positioned relative to the plug 30 by contacting a tip of the plug 30 with a step portion of the inserting portion 23. An inner diameter of the plug 30 has the same size as an outer diameter of the inserting portion 23 so that the inserting portion 23 is inserted without shaking.

A rear portion of the plug 30 which leaves the undercut 31 and 32 is a fixed part which is interfitted to the inner surface of the tip of the exterior cylinder 11. A further rear portion of the plug 30 has an outer diameter smaller than the rear part of the plug 30 which is interfitted to the cylinder and is provided with four slits 36 disposed at intervals of an angle of 90° to each other. Therefore, the further rear portion of the plug 30 is divided by four portions as shown in FIG. 6. Two portions among the four divided portions which are positioned axial symmetrically are cartridge holding pieces 34. The cartridge holding pieces 34 have flexibility by disposing slits 36 because the plug is made of elastic material. The cartridge holding pieces 34 have holding ribs 35 having a shape of an arc along an inner surface in an arc shape. The holding ribs 35 are engaged in an annular engaging groove 26 which is formed to the inserting portion 23 of the cartridge body 20 shown in FIG. 1 with the inserting portion 23 inserting to the most inner part of the plug 30. Furthermore, the holding ribs 35 prevent the inserting portion 23 from dropping by a click. Therefore, the cartridge 20 is removable relative to the exterior cylinder 11 through plug 30 and is capable of being rotatably supported and not capable of sliding along an axial direction of the plug 30 with small force. The other portions except for the cartridge holding pieces 34 among the four portions divided by the slits 36 further extend rearward from the position of slits 36, namely, from the position of cartridge holding pieces 34. The ends of these parts support a stopper 37. The stopper 37 is coaxial with the plug 30 and has a cylindrical shape. The stopper 37 has a through hole 37*a* formed in a central axis of the stopper 37. The through hole 37*a* has a round shape and a small diameter smaller than an inner surface 30*a* of the plug 30. The stopper 37 is formed integrally with the plug 30.

Figure 4:
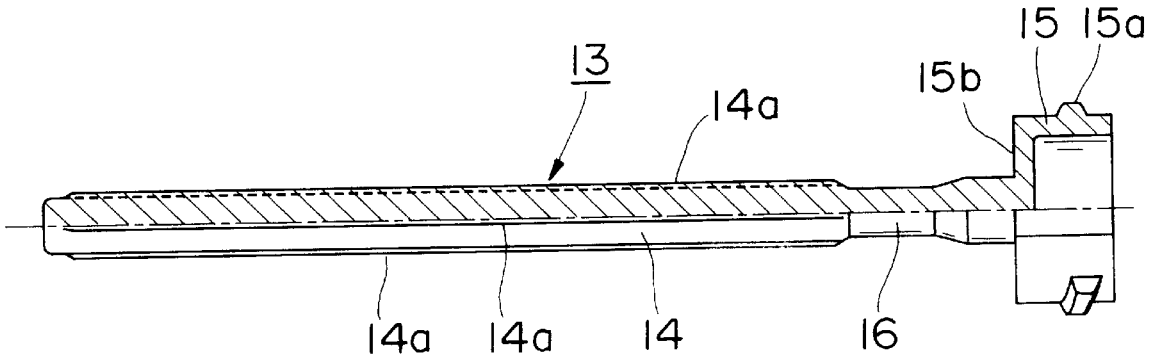
FIG. 4 is a semi vertical section of an extruding rod 13 shown in FIG. 1.
Figure 5:
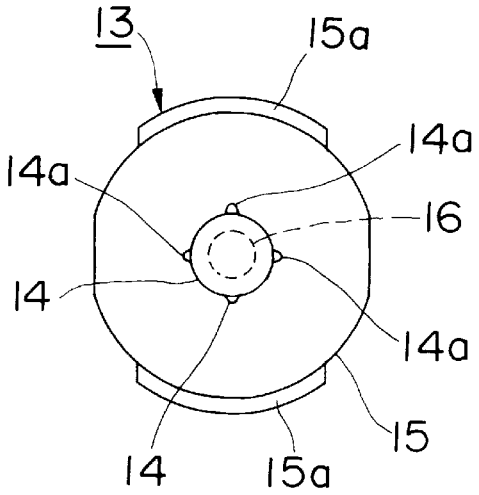
FIG. 5 is a front view of the extruding rod 13 of FIG. 4 from the distal end side of the cartridge-type feeding case.

Turning to FIG. 1, the exterior cylinder 11 has an extruding rod 13 which is inserted in a middle portion of the exterior cylinder 11. The shape of the extruding rod 13 is shown in FIG. 4 and FIG. 5. As shown in FIG. 4, the extruding rod 13 is produced by coaxially integrating a small diameter shaft 14 with a protrusion forming part 15. An outer diameter of the protrusion forming part 15 has the same size as a diameter of a top of the helicoidal groove 12. The protrusion forming part 15 has a helicoidal protrusion 15*a* having a shape of a male screw threaded with the helicoidal groove 12, on a periphery of the protrusion forming part 15. The protrusion forming part 15 moves back or forward along an axial direction of the extruding rod 13, rotating relative to the exterior cylinder 11 by engaging the helicoidal groove 12 to helicoidal protrusions 15*a*. However, on a proximal end of the exterior cylinder 11, the protrusion forming part 15 is prevented from further moving by contacting the helicoidal protrusion 15*a* with an end of the helicoidal groove 12, as shown in FIG. 1. The protrusion forming part 15 has a distal side face 15*b* at a distal side thereof. The stopper 37 has a proximal side face 37*b* at a proximal side thereof. On the distal end of the exterior cylinder 11, the distal side face 15*b* interacts with the proximal side face 37*b*. Therefore, the protrusion forming part 15 is prevented from moving over the interacted position where the distal side face 15*b* contacts the proximal side face 37*b*. As shown in FIG. 5, the helicoidal protrusions 15*a* are formed in angle ranges of 90° at two positions axial-symmetrically opposed to the central axis of the extruding rod 13, respectively. At a portion between the two helicoidal protrusions 15*a* and 15*a*, a peripheral surface of the protrusion forming part 15 is partially cut off, respectively. This cut off is formed to make the pulling out of the protrusion forming part 15 from a cavity of a mold easy during a molding of the extruding rod 13. The mold is divided in two parts along the axial direction of the mold. The length of the protrusion forming part 15 along the axial direction thereof is shorter than a distance from the distal end of the helicoidal groove 12 to the proximal side face 37*b* of the stopper 37.

As shown in FIG. 4 and FIG. 5, the shaft 14 has a substantially cylindrical shape. The shaft 14 has a plurality of concave rotary passive ribs 14*a* which are radially formed at regular intervals on a periphery of the shaft. The rotary passive ribs 14*a* linearly extend along a length direction of the extruding rod 13.

The shaft 14 of the extruding rod 13 having such a sectional shape passes through the through hole 37*a* of the stopper 37 which has a larger inner diameter than the diameter of the shaft 14 with the ribs 14*a* shown by FIG. 1. Furthermore, when the cartridge C is inserted in the case body 10, the distal end of the shaft 14 is contactly inserted into the rotary driving hole 24*a* of the rear plug 24. The rotary driving hole 24*a* of the rear plug 24 is formed in the similar shape as the sectional shape of the extruding rod 13. The extruding rod 13 becomes capable of accepting rotation from the cartridge C through the rotary driving hole 24*a* of the rear plug 24 by a slide contact between the rotary driving hole 24*a* and shaft 14. The extruding rod 13 is capable of sliding along the axial direction relative to the rear plug 24.

The shaft 14 has a clutch release portion 16 having a smaller diameter than an outer diameter of the other portion of the shaft 14 at a position adjacent to the protrusion forming part 15 near the proximal end of the shaft 14.

Referring to FIG. 1, the shaft 14 is inserted into an elastic ring 39 at a part which is protruded toward the distal end side from the stopper 37. The elastic ring 39 is made of rubber. An inner diameter of the elastic ring 39 is usually smaller than the outer diameter of the shaft 14 and larger than the outer diameter of the clutch release portion 16. Therefore, the elastic ring 39 is prevented form dropping out from the shaft 14 because of frictional resistance between the shaft 14 and the elastic ring 39 even under the condition that the cartridge C is removed from the case body 10.

Furthermore, when the cartridge C is inserted into the case body 10, the elastic ring 39 is caught between the stopper 37 and the rear plug 24 thus restricting the movement of the elastic ring 39. Therefore, the extruding rod 13 is applied sliding resistance by a slide contact between an inner surface of. the elastic ring 39 and an outer surface of the shaft 14 with elasticity of the elastic ring 39.

When the protrusion forming part 15 of the extruding rod 13 is positioned between the stopper 37 and the helicoidal groove 12, the elastic ring 39 is restricted in its movement as the same above mentioned is positioned at the clutch release portion 16. Therefore, an engagement between the elastic ring 39 and the extruding rod 13 is free to be released so that the sliding resistance to the shaft 14 is released (See FIG. 2). Under such condition, the extruding rod 13 is released not only relative to the elastic ring 39 but also with respect to its movement along the axial direction by releasing the engagement between the helicoidal protrusion 15*a* of the protrusion forming part 15 and the helicoidal groove 12 (See FIG. 2).

The engagement between the rotary driving hole 24*a* of the rear plug 24 and the shaft 14 of the extruding rod 13 may be released by providing a small diameter part like a clutch release portion 16 to the shaft 14 under the condition that the protrusion forming part 15 of the extruding rod 13 is positioned between the stopper 37 and the helicoidal groove 12. Thereby, the rotation of the cartridge C is prevented from transmitting to the extruding rod 13.

The condition that the sliding resistance or movement should be released means a condition of maximum stroke that the extruding rod 13 is moved fully forward or a condition that the solid cosmetic 22 is maximally fed or is completely consumed.

Figure 2:
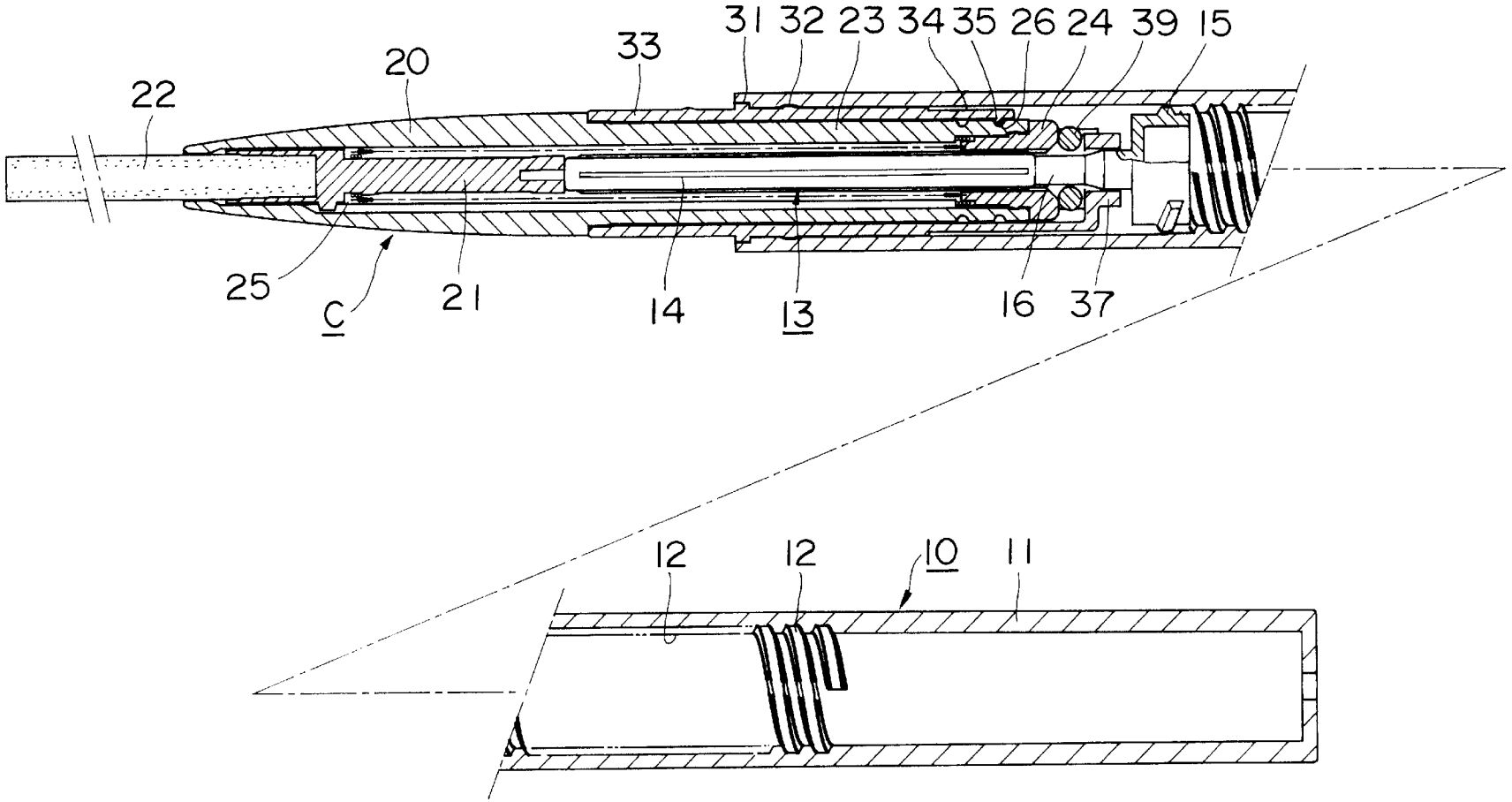
FIG. 2 is a vertical section of a cartridge-type feeding case for feeding a solid object according to the first embodiment of the present invention, in which the solid object is projected.

The description will now be made of operation and function of the feeding case according to the first embodiment structured as above mainly with regard to FIG. 1 and FIG. 2.

FIG. 1 shows the protecting condition which the case body 10 is covered by the cap 40 and the cartridge C is installed into the case body 10 through the plug 30.

In the operation, at first, the cap 40 is taken off from the cap applied portion 33 of the plug 30 and kept individually, exposing the cartridge for use. Thereafter, the solid cosmetic 22 accommodated in the cartridge C is projected for a suitable length thereof. For projecting the solid cosmetic 22, the cartridge 20 is held and fixed when the exterior cylinder 11 of the case body 10 is rotated, or, the cartridge C is rotated when the exterior cylinder 11 of the case body 10 is held and fixed. The cartridge C and the exterior cylinder 11 of the case body are thus relatively rotated.

The shaft of the extruding rod 13 has a plurality of the rotary passive ribs 14*a* disposed over the whole length on the periphery of the shaft 13. Therefore, the relative rotation between the cartridge C and the case body 10 is transmitted to the extruding rod 13 by an engagement between the rotary driving hole 24*a* of the rear plug 24 and the shaft 14. The rotation is transmitted to the extruding rod 13 to move back or forward in the axial direction of the extruding rod 13 relative to the exterior cylinder 11 of the case body 10 by helicoidal movement between the helicoidal protrusion 15*a* of the protrusion forming part 15 and the helicoidal groove 12.

In this event, the shaft 14 and the rotary driving hole 24*a* are capable of moving back and forward. The torque of the cartridge C applies forwarding force relative to the case body 10 to the extruding rod 13 with applying rotating force to the extruding rod 13 by the engagement between the rear plug 24 and shaft 14. Therefore, when the cartridge C is rotated relative to the case body 10 in a clockwise direction looking from the distal end of cartridge, the extruding rod 13 moves forward in a distal end direction.

The rear plug 24 and the cartridge body 20 are interfited into the plug 30, namely into the case body 10, and are not capable of sliding along an axial direction of the case body 10 with small force. Therefore, it is impossible for the extruding rod 13 to move the cartridge C outside the case body 10.

The core chuck 21 is pushed from a back side thereof with the tip of the shaft 14 of the extruding rod 13 against the extension spring 25. As shown in FIG. 2, the stick type solid cosmetic 22 supported by the core chuck 14 is then fed from the tip opening of the cartridge body 20.

After using the solid cosmetic 22, the solid cosmetic 22 is withdrawn and accommodated in the cartridge body 20 by relative converse rotation contrary to the above feeding. In other words, the cartridge C rotating in a counter direction to the extruding rod 13, moves backward to the proximal end of exterior cylinder, so that the core chuck 21 being fed against the extension spring 25 is drawn to a predetermined place in the cartridge body 20 by contraction force of the extension spring 25. At the same time, the solid cosmetic 22 is also accommodated in the predetermined place in the cartridge body 20.

The elastic ring 39 applies sliding resistance to the movement of the extruding rod 13 when the extruding rod 13 is moved forwardly, namely, when the solid cosmetic 22 is fed. The user is then given the appropriate operational feeling on feeding by offsetting the spring force of the extension spring 25. Conversely, when the extruding rod 13 is moved back by the extension spring 25, the elastic ring 39 applies sliding resistance to the backward movement of the extruding rod 13 to reduce quick return.

A forwarding stroke of the extruding rod 13 becomes longer every time after the solid cosmetic 22 was shortened by being consumed. Eventually, the distal side face 15*b* of the protrusion forming part 15 is about to contact to the proximal side face 37*b* of the stopper 37 at the rear of the plug 30. As shown in FIG. 2, at this stage, the helicoidal protrusion 15*a* of the protrusion forming part 15 at the proximal end of the extruding rod 13 is released from the engagement with the helicoidal groove 12 of the exterior cylinder 11. Therefore, the extruding rod 13 is released from transmission of the back and forward movement from along the axial direction. At the same time, the extruding rod 13 is released from sliding resistance by the elastic ring 39 because the elastic ring 39 is positioned at the clutch release portion 16.

At this point, the user can recognize that the relative rotation is idle by reduced sliding resistance. Even if the user further rotates the cartridge, the distal side face 15*b* of the protrusion forming part 15 never presses the proximal side face 37*b* of the stopper 37 at the rear of the plug 30, so that there is no overstrain of the relative rotation between the cartridge body 20 and the exterior cylinder 11. Thus the feeding case is protected. When the solid cosmetic 22 is protruded with useless length from the cartridge 20, the user substitutes the cartridge C with new one, or installs a new solid cosmetic 22 to the core chuck 21.

When the new cartridge C is installed corresponding to the necessity, the cylindrical inserting portion 23 of the cartridge body 20 is installed through the plug 30 into the exterior cylinder 11 of the case body 10. After the insertion, the annular engage groove 26 of the cartridge, body 20 is engaged to the holding rib 35 of the cartridge holding piece 34 of plug 30. Thereby, the cartridge body 20 is rotatably held in place and prevented from moving back and forward.

Second Embodiment

Figure 9:
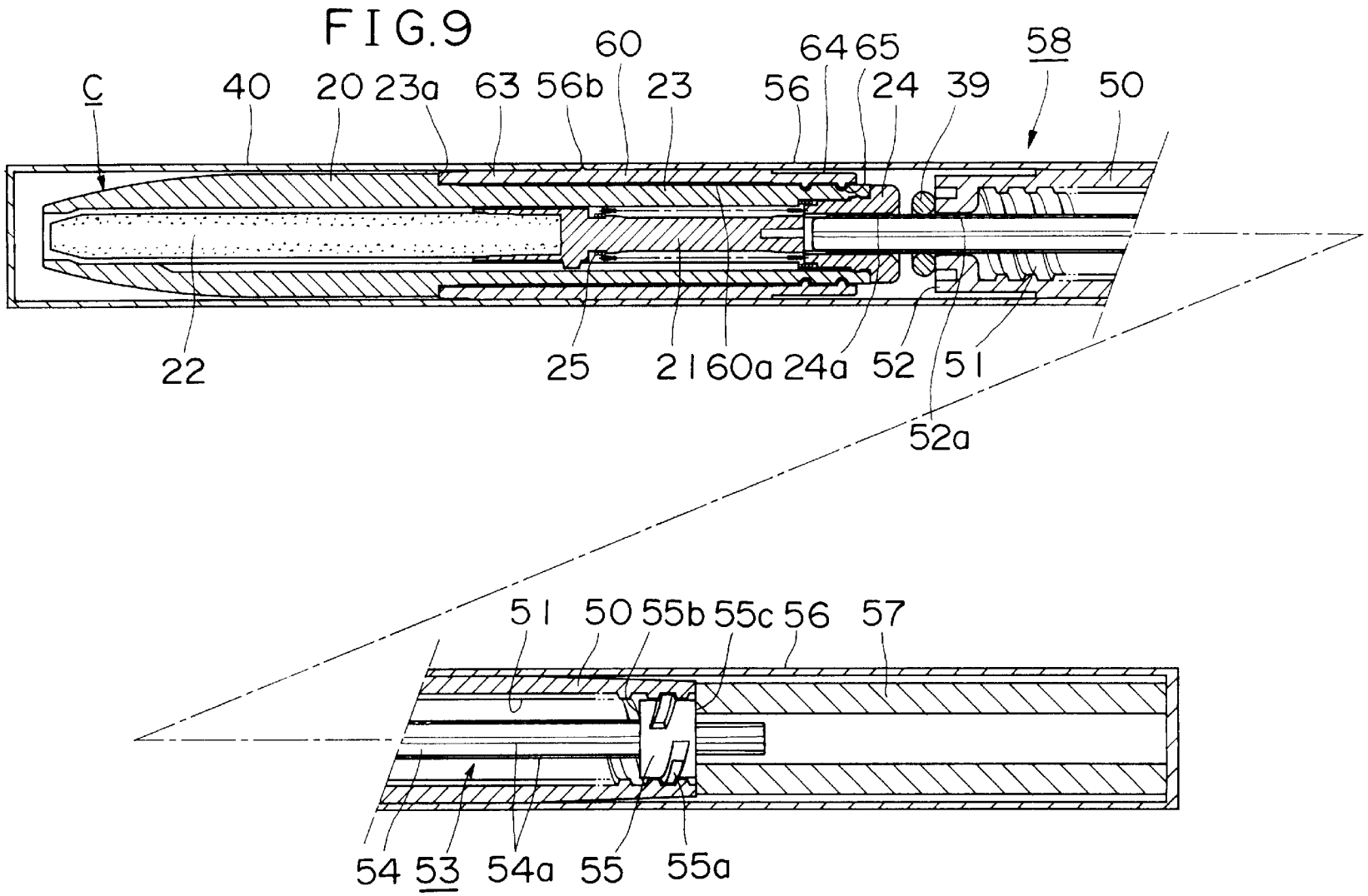
FIG. 9 is a vertical section of a cartridge-type feeding case for feeding a solid object according to a second embodiment of the present invention, in which the solid object is installed.
Figure 10:
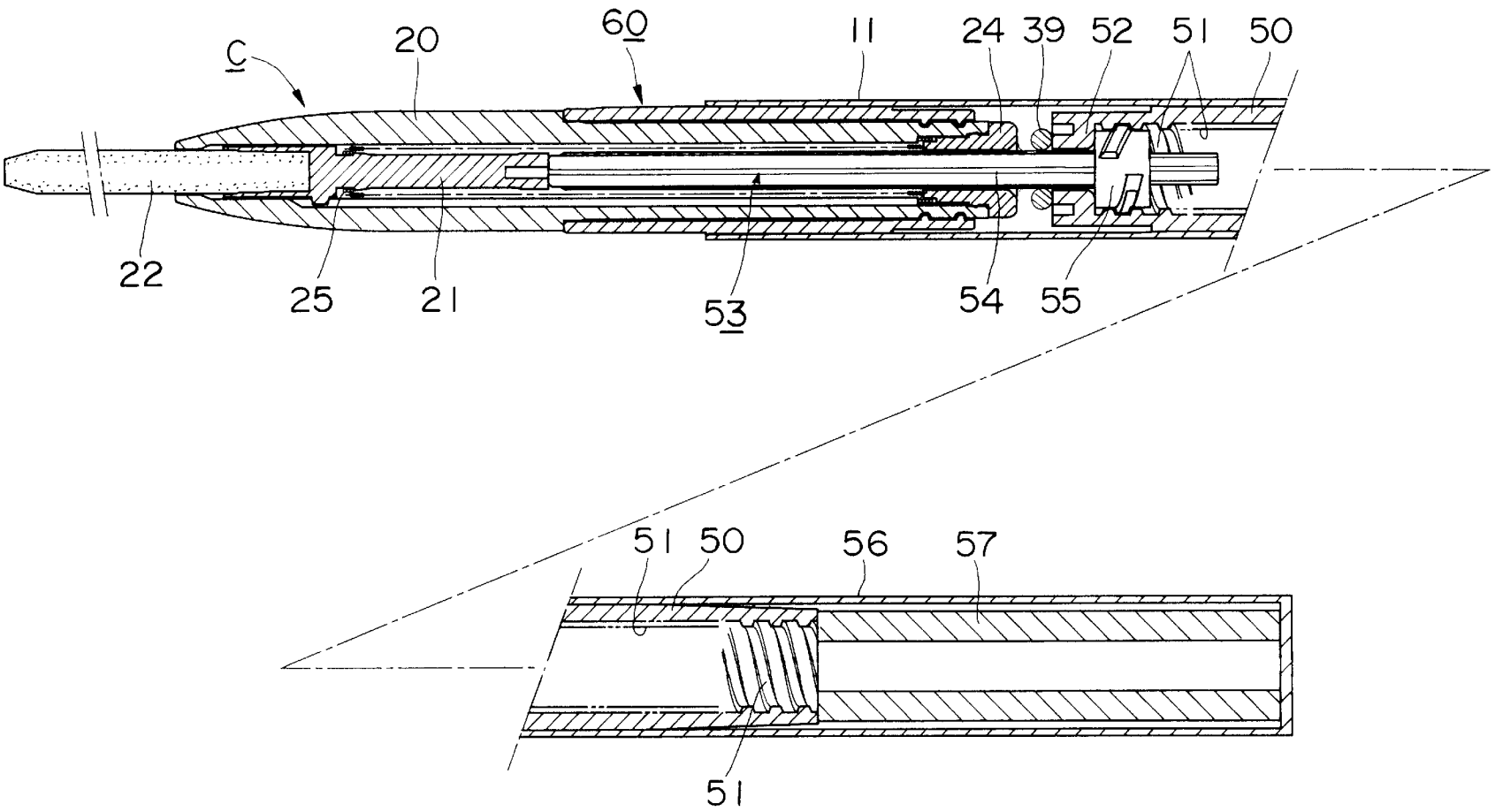
FIG. 10 is a vertical section of a cartridge-type feeding case for feeding a solid object according to the second embodiment of the present invention, in which the solid object is projected.

FIG. 9 and FIG. 10 show an apparatus according to a second embodiment of the present invention. As shown in FIG. 9, a feeding case according to the second embodiment has a cartridge C and a cap 40 having almost the same structures of the cartridge C and the cap 40 in the first embodiment. In regard to the cartridge C and the cap 40, therefore, the description is omitted about the same numeral parts.

The cartridge C is removably contacted to a distal end of a cylindrical case body 58 as in the first embodiment. The feeding case comprises the case body 58 and the cartridge C.

The description will now be made of the structure of the case body 58. The case body 58 has an exterior cylinder 56 as an exterior case of the case body, which has a bottomed cylindrical shape. A screw cylinder 50 having a cylindrical shape is inserted and fitted into a central portion of an inner part of the exterior cylinder 58. A helicoidal groove 51 has a type of female screw thread which is formed in an inner surface of the screw cylinder 50. A stopper portion 52 having a diameter smaller than the top of the helicoidal groove is formed at a distal end of the screw cylinder 50.

A spacer 57 is disposed at an inner part of the screw cylinder 50 in the exterior cylinder 56. The spacer 57 has an inner diameter smaller than an inner diameter of the screw cylinder 50.

A plug 60 is disposed at an opening end 56*b* of the exterior cylinder 56 for mediating between the cartridge C and the case body 58. The structure of the plug 60 is almost the same as the plug 30 of the first embodiment except for the structure of the proximal end thereof. The proximal end of plug 60 has a diameter smaller than the other part thereof and is provided with slits (not shown) disposed at two parts positioned axial symmetrically relative to the axis thereof. Two protruding portions defined by the slits are cartridge holding pieces 65 for holding the cartridge C. Therefore, the plug 60 has no stopper like the stopper 37 of plug 30 according to the first embodiment. The description of the other structure of the plug 60 is omitted because the other structure of the plug 60 is the same as the other structure of the plug 30.

An extruding rod 53 is installed into a central part of the exterior cylinder 56. As shown in FIG. 9, the extruding rod 53 comprises a small diameter shaft 54 and a protrusion forming part 55 having a diameter larger than a diameter of the shaft 54. An outer diameter of the protrusion forming part 55 is almost the same as an inner diameter of the top of the helicoidal groove 51. The protrusion forming part 55 has helicoidal protrusion 55*a* having a shape of a male screw thread for engaging the helicoidal groove 51 provided around a periphery of the protrusion forming part 55. The protrusion forming part 55 rotates and moves back and forward in the exterior cylinder 11 along an axial direction of the exterior cylinder 11 by threadedly engaging the helicoidal protrusion 55*a* of the helicoidal groove 51. The protrusion forming part 55 has a proximal side face 55*c* at a proximal end of the protrusion forming part 55. The proximal side face 55*c* interacts with the spacer 57 having an inner diameter smaller than the outer diameter of the protrusion forming part 55. Therefore, the proximal side face 55*c* is not allowed to rearwardly move over the interacting position where the proximal side face 55*c* contacts the proximal side face 37*b*. The protrusion forming part 55 has a distal side face 55*b* at a distal side of the protrusion forming part 55. The distal side face 55*b* interacts with the stopper portion 52 having an inner diameter smaller than the outer diameter of the protrusion forming part 55. Therefore, the distal side face 55*b* is not allowed to forwardly move over the interacting position where the distal side face 55*b* contacts the stopper portion 52. The helicoidal protrusions 55*a* and 55*a* are formed in an angle range of 90° at two positions opposed to the central axis of the extruding rod 53 axial-symmetrically each other. The shaft 54 has a substantially cylindrical shape. The shaft 54 has a plurality of convex rotary passive ribs 54*a* formed on a periphery of the shaft 54 radially like the shaft 14 according to the first embodiment. The rotary passive ribs 54*a* extend along a length direction of the extruding rod 53 linearly. The shaft 54 of the extruding rod 53 in a sectional shape passes through the through hole 52*a* of the stopper portion 52. Furthermore, in the condition that the cartridge C is inserted in the case body 58, the distal end of the shaft 54 is contactly inserted into the rotary driving hole 24*a* of the rear plug 24. The rotary driving hole 24*a* of the rear plug 24 is formed in the similar shape as the sectional shape of the extruding rod 53. The extruding rod 53 is allowed to be applied with rotation from the cartridge C through the rotary driving hole 24*a* of the rear plug 24 by a slide contact between the rotary driving hole 24*a* and shaft 54. Furthermore, the extruding rod 53 is capable of sliding along the axial direction relative to the rear plug 24.

The shaft 54 is inserted into an elastic ring 39 at a part which is protruded toward the distal end side from the stopper portion 52. The elastic ring 39 is formed like that of the first embodiment. When the cartridge C is installed into the case body 58, the elastic ring 39 is caught between the stopper portion 52 and the rear plug 24, which limits the movement of the elastic ring 39. Therefore, the extruding rod 53 has sliding resistance by a slide contact between an inner surface of the elastic ring 39 and an outer surface of the shaft 54 with elasticity of the elastic ring 39.

The description will now be made regarding the operation and function of the feeding case according to the second embodiment structured above.

First, the cartridge C and the case body 58 are rotated relatively as in the first embodiment. The rotation is transmitted to the extruding rod 53 by engagement between the rotary driving hole 24*a* of the rear plug 24 and the shaft 54. The rotation is transmitted to the extruding rod 53 to move back or forward in the axial direction of the extruding rod 53 relative to the exterior cylinder 56 of the case body 58 by helicoidal movement between the helicoidal protrusion 55*a* of the protrusion forming part 55 and the helicoidal groove 51.

The core chuck 21 is pushed by the extruding rod 53 at a back of the core chuck 21 with the distal end of the shaft 54 against the extension spring 25. As shown in FIG. 10, the stick type solid cosmetic 22 supported to the core chuck is then fed from the tip opening of the cartridge body 20.

After using the solid cosmetic 22, the solid cosmetic 22 is drawn and accommodated in the cartridge body 20 by converse relative rotation contrary to the above on feeding. In other words, when the cartridge C rotates in a counter direction, the extruding rod 53 moves backward to the proximal end of exterior cylinder 56. The core chuck 21 fed against the extension spring 25 is drawn in place in the cartridge body 20 by shrinkage force of the extension spring 25. At the same time, the solid cosmetic is also accommodated in the cartridge body 20 in place.

The elastic ring 39 applies sliding resistance to the movement of the extruding rod 53 is moved when the extruding rod 53 forward, namely, when the solid cosmetic 22 is fed. The user is then given the good operational feeling on feeding by offsetting the spring force of the extension spring 25. Conversely, when the extruding rod 53 is moved back by the extension spring 25, the elastic ring 39 applies sliding resistance to the backward movement of the extruding rod 53 to reduce quick return.

Third Embodiment

Figure 11:
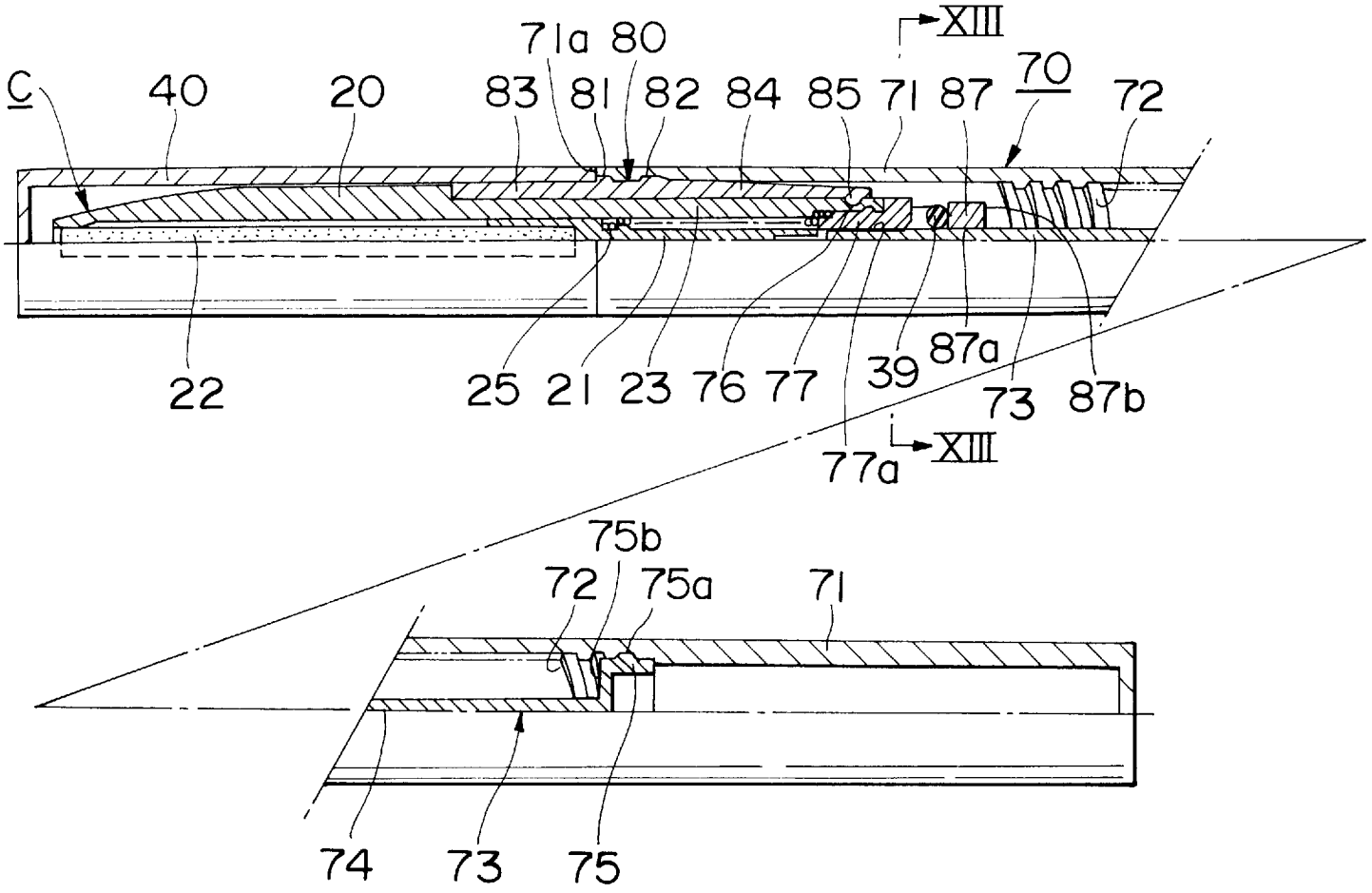
FIG. 11 is a vertical section of a cartridge-type feeding case for feeding a solid object according to a third embodiment of the present invention, in which the solid object is installed.
Figure 12:
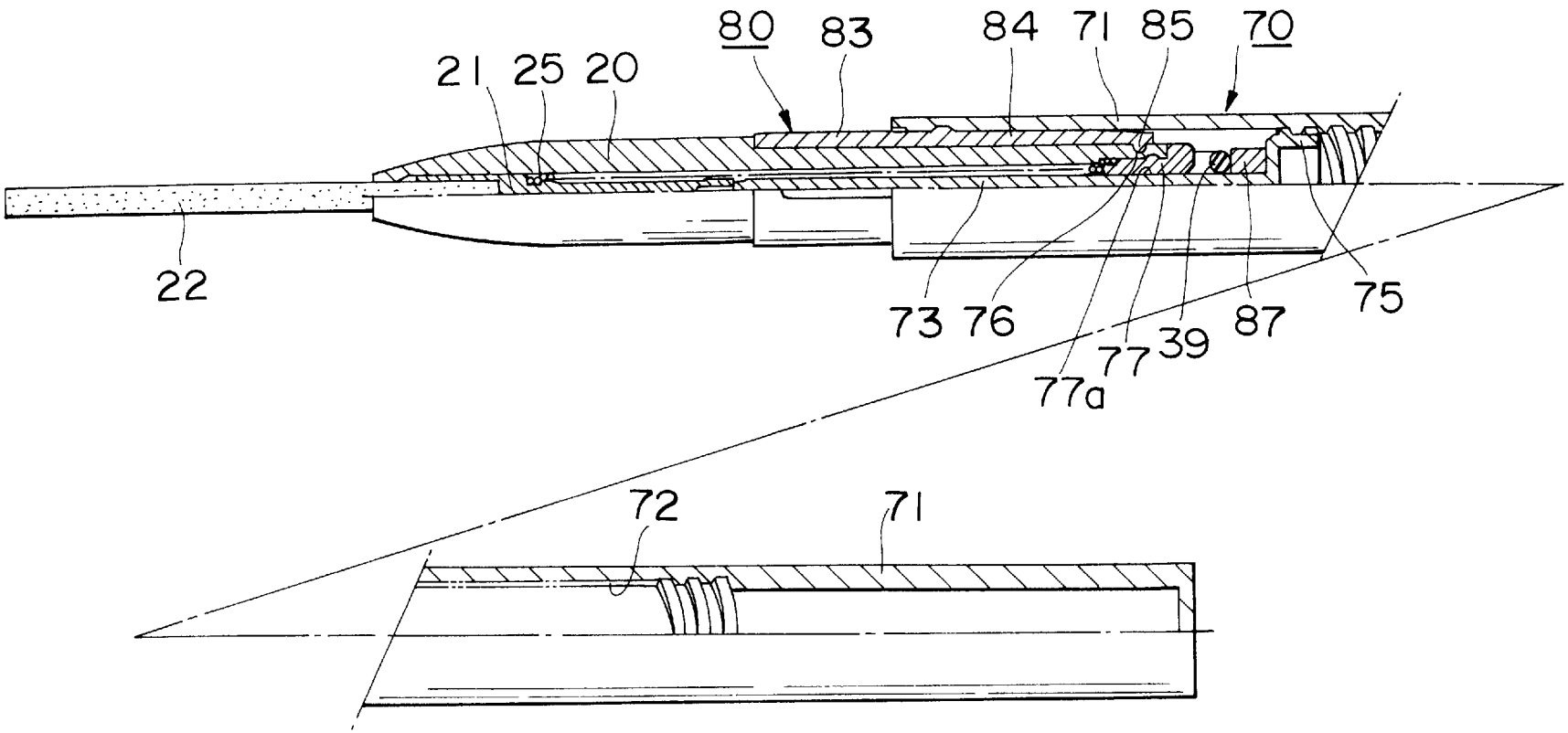
FIG. 12 is a vertical section of a cartridge-type feeding case for feeding a solid object according to the third embodiment of the present invention, in which the solid object is projected.
Figure 13:
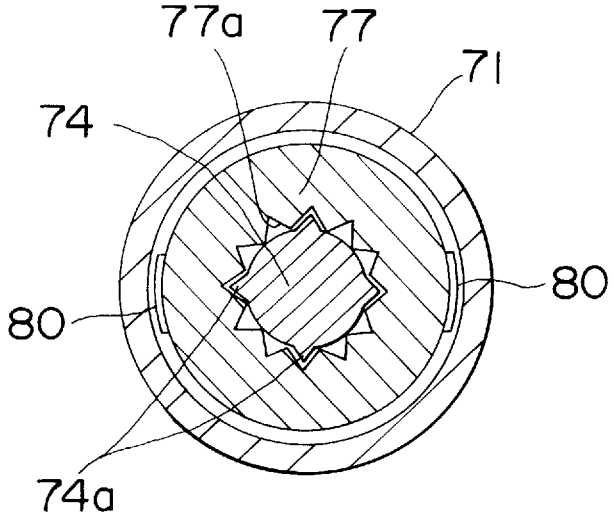
FIG. 13 is a transverse cross section of the cartridge-type feeding case shown in FIG. 11 taken on a line XIII—XIII.

FIG. 11 shows an apparatus according to a third embodiment of the present invention. As shown in FIG. 11, a feeding case according to the third embodiment has a cartridge C and a cap 40 having almost the same structures of the cartridge C and the cap 40 as the first embodiment. In regard to the cartridge C and the cap 40, therefore, the numerals are the same and the description is omitted. However a through hole 77*a* of a rear plug 77 of the cartridge C has a interfitting sectional shape such as a sprocket, a serration or the like as shown in FIG. 13. Thereby, the cartridge C is installed easily because the number of available relative rotational position of the cartridge C relative to the extruding rod 73 when the cartridge C is installed in a case body 70 is larger than that of the first embodiment.

As described in the first embodiment, the cartridge C is removably contacted to a distal end of the cylindrical case body 70. A feeding case comprises the case body 70 and the cartridge C.

The description will now be made regarding the structure of the case body 70. The case body 70 has an exterior cylinder 71 as an exterior case of the case body 70, which has the same structure as the exterior case 11 of the first embodiment. A helicoidal groove 72 having a shape of a female screw thread is formed in a central portion of an inner surface of the exterior cylinder 71.

Figure 14:
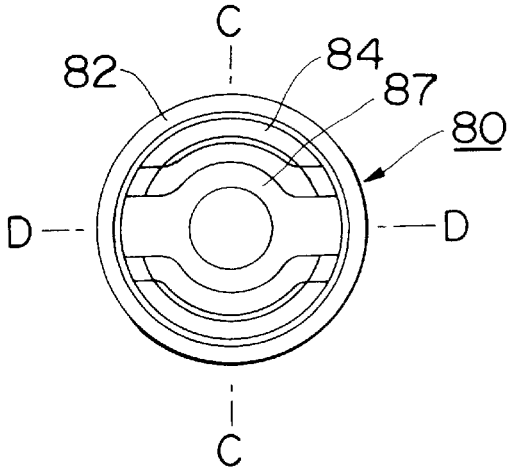
FIG. 14 is a rear view of a plug 80 of FIG. 11 from the proximal end side of the cartridge-type feeding case.
Figure 15:
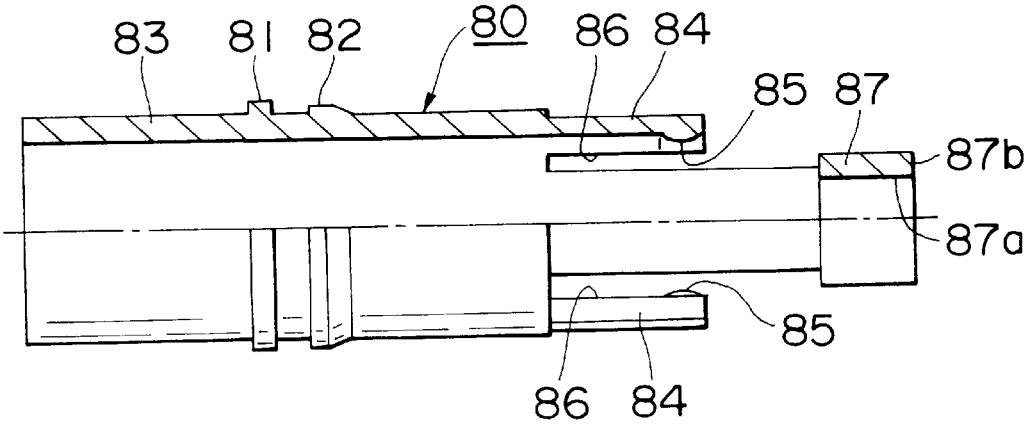
FIG. 15 is a semi vertical section of the plug 80 shown in FIG. 14 taken on a line C—C and from a direction D.
Figure 16:
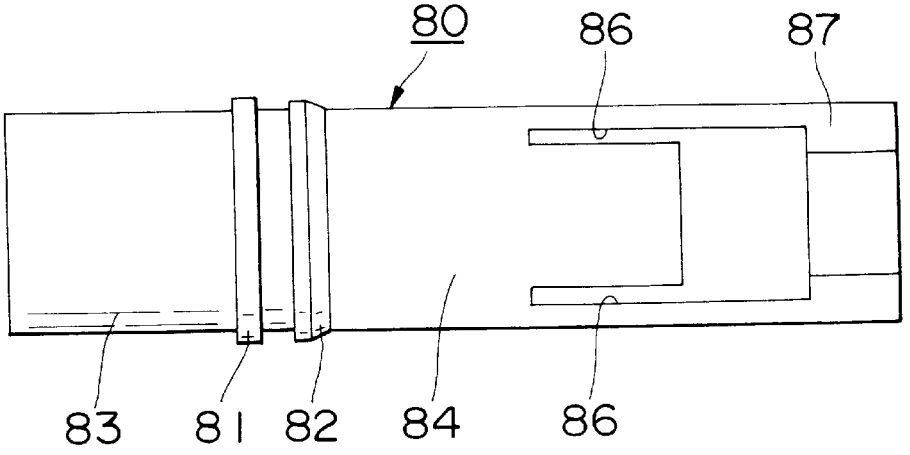
FIG. 16 is a side view of the plug 80 shown in FIG. 14 taken on a line D—D and from a direction C.
Figure 17:
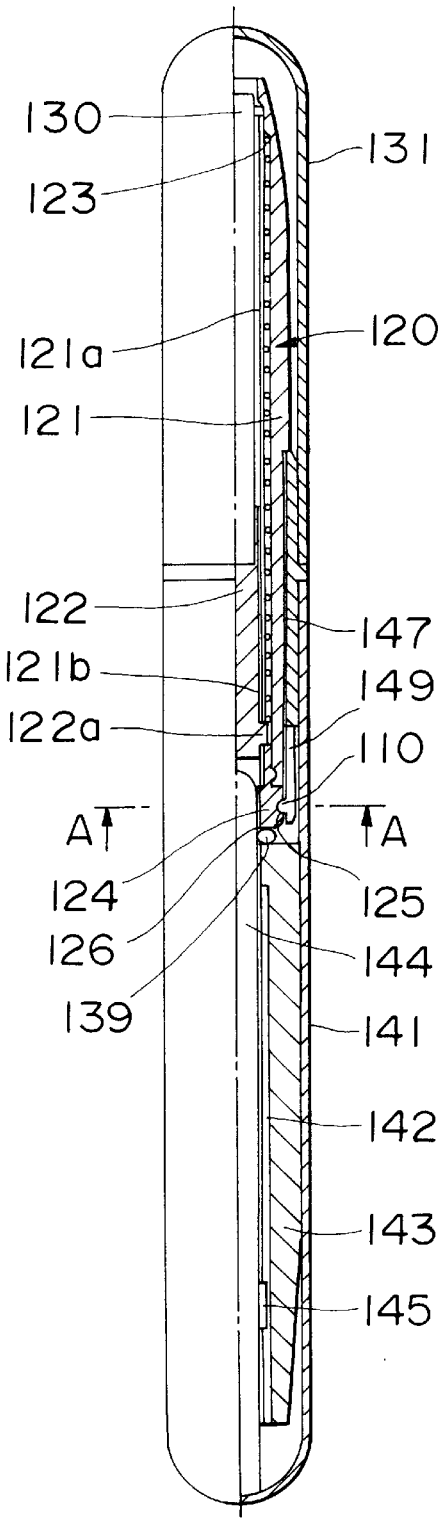
FIG. 17 is a vertical section of a cartridge-type feeding case for feeding a solid object according to a fourth embodiment of the present invention, in which the solid object is installed.
Figure 18:
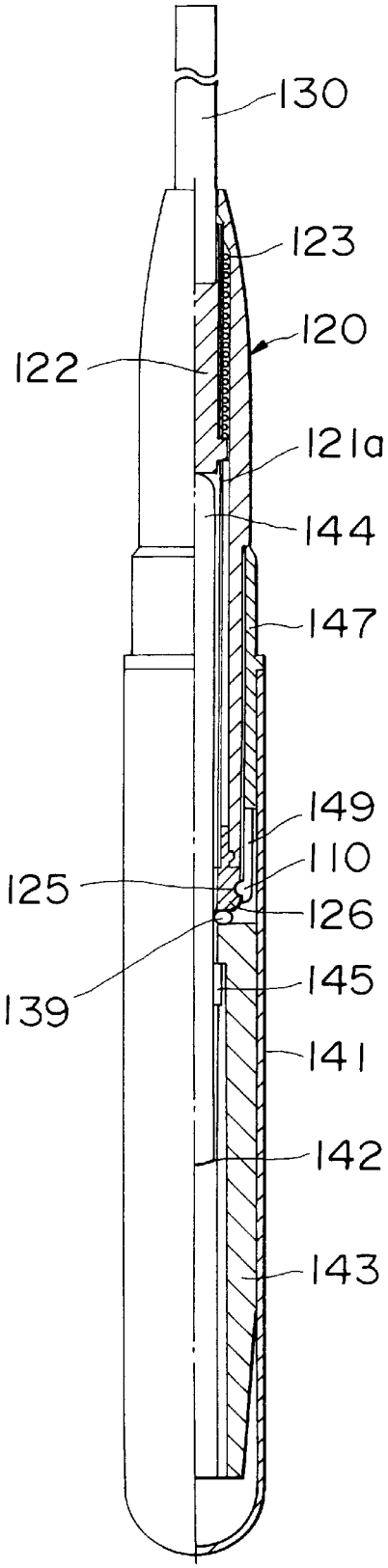
FIG. 18 is a vertical section of a cartridge-type feeding case for feeding a solid object according to the fourth embodiment of the present invention, in which the solid object is projected.

A plug 80 is disposed to an opening end 71*a* of the exterior cylinder 71 for mediating between the cartridge C and the case body 70. The structure of the plug 80 is almost the same as the plug 30 of the first embodiment. However, a shape of a supporting portion for a stopper 87 of the plug 80 is slightly different from that of the plug 30. As shown in FIG. 14–FIG. 16, protruding pieces for supporting the stopper 87 are formed slender because slits 86 are formed wide. The description of the other structure of the plug 80 is omitted because the other structure of the plug 80, is the same as the other structure of the plug 30.

Turning to FIG. 11, the extruding rod 73 is inserted into a central portion of the exterior cylinder 71. The extruding rod 73 is constructed by coaxially integrating a small diameter shaft 74 with a protrusion forming part 75 having a large diameter. An outer diameter of the protrusion forming part 75 is about the same as an inner diameter of a top of the helicoidal groove 72. The protrusion forming part 75 has a helicoidal protrusion 75*a* formed around a periphery of the protrusion forming part 75 for threadedly engaging the helicoidal groove 72. The helicoidal protrusion 75*a* has a shape of a male screw thread. The protrusion forming part 75 rotates and moves back and forward in the exterior cylinder 71 along an axial direction thereof by threadedly engaging the helicoidal groove 72 to the helicoidal protrusion 75*a*. At a proximal end of the helicoidal groove 72, the protrusion forming part 75 is not allowed to rearwardly move further by contacting the helicoidal protrusion 75*a* with an end of the helicoidal groove 72. FIG. 11 shows this engaging contact. Furthermore, at a proximal side face 87*b* of the stopper 87, the protrusion forming part 75 is not allowed to forwardly move furthermore by contacting of the protrusion forming part 75 with a proximal side face 87*b* of the stopper 87.

As shown in FIG. 13, the shaft 74 has a substantially cylindrical shape. At the periphery of the shaft 74, four convex rotary passive ribs 74*a* are formed radially at regular angular intervals. The rotary passive ribs 74*a* extend along a length direction of the extruding rod 73 linearly. Each of the rotary passive ribs 74*a* is engaged to any one of twelve concaves of a sprocket or a serration formed on the inner surface of the through hole 77*a* of the rear plug 77. It is not necessary that the number of rotary passive ribs 14*a* correspond to all concaves of the sprocket or the serration.

The shaft 74 of the extruding rod 73 having such a sectional shape passes through the through hole 87*a* of the stopper 87 of which the inner diameter is larger than the whole outer diameter of the rod 73 with the ribs 74*a*. Furthermore, when the cartridge C is installed in the case body 70, a distal end of shaft 74 is contactably inserted into the rotary driving hole 77*a* of the rear plug 77. FIG. 13 shows the section of the feeding case in this condition. The extruding rod 73 is allowed to be applied with rotation from the cartridge C through the rotary driving hole 77*a* of the rear plug 77 by a slide contact between the rotary driving hole 77*a* and shaft 74. The extruding rod 73 is capable of sliding along the axial direction relative to the rear plug 77.

The shaft 74 is inserted into an elastic ring 39 at a part of the shaft 74 which is protruded from the stopper 87 toward the distal end side. The elastic ring 39 is formed the same as that of the first embodiment. When the cartridge C is installed into the case body 70, the elastic ring 39 is caught between the stopper 87 and the rear plug 77, which restricts the movement of the elastic ring 39. Therefore, the extruding rod 73 applies sliding resistance by a slide contact between an inner surface of the elastic ring 39 and an outer surface of the shaft 74 with elasticity of the elastic ring 39.

The description for operation and function of the feeding case according to the third embodiment structured above is omitted because they are almost the same as that of the feeding case according to the second embodiment. However, it should be understood that the plug 80 has a function for holding the cartridge in the plug 80 and with a function for defining the forward movement of the extruding rod 73 because the plug 80 has the stopper 87 integrally. Thereby, it is possible to decrease the number of the parts and the product steps.

Fourth Embodiment

FIGS. 17, 18, 19, and 20 show an apparatus according to a fourth embodiment of the present invention. As compared with the apparatus according to the second embodiment, the apparatus according to the fourth embodiment is characterized by providing a circumferential groove around a periphery of a rear plug 124 for engaging a plug 147.

Figure 19:
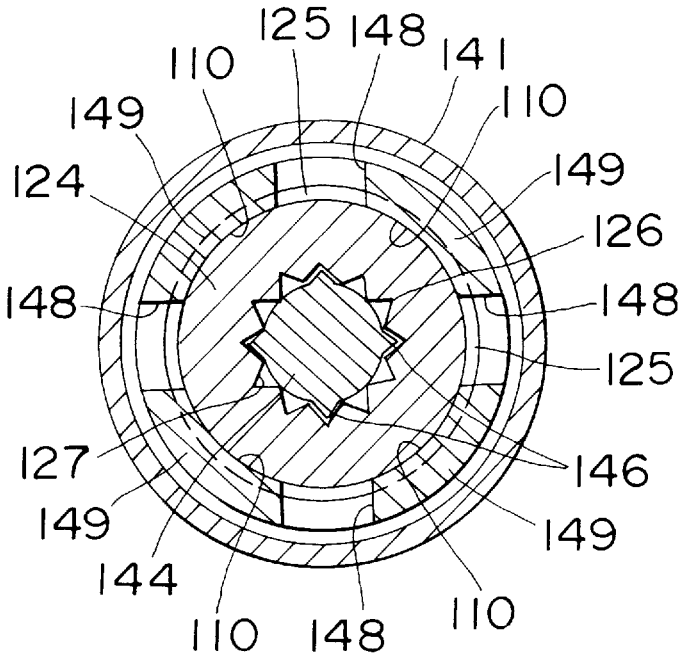
FIG. 19 is a transverse cross section of the cartridge-type feeding case shown in FIG. 17 taken on a line A—A.

A case body 141 has a cylindrical shape and has an opening at a distal end thereof. A helical cylinder 143 has a helicoidal groove 142 formed on an inner surface of the helical cylinder 143. The helical cylinder 143 is threadedly fixed inside the case body 141. An extruding rod 144 is rotatably installed into the helical cylinder 143. The extruding rod 144 has a protrusion 145 disposed on a proximal end side of the extruding rod 144. The protrusion 145 is inserted into the helicoidal groove 142 for engagement. When the helical cylinder 143 rotates relative to the extruding rod 144, the protrusion 145 is extruded by the helicoidal groove 142 so that the extruding rod 144 moves back and forward from the distal end of the case body 141 along an axial direction of the helical cylinder 143. The extruding rod 144 is provided with four projections 146 along an axial direction of the extruding rod 144 and each of the projections 146 has a sectional triangle shape as shown in FIG. 19.

A connecting pipe 147 is threadedly fixed inside the distal end of the case body 141. As shown in FIG. 19, the connecting pipe 147 is provided with four slits 148 so that four cartridge supporting pieces 149 are substantially formed annularly and each of engaging gaps 110 is disposed on and protrudes from an inner surface of each cartridge supporting piece 149 and is substantially formed annularly. Each of the cartridge supporting pieces 149 has elasticity.

Figure 20:
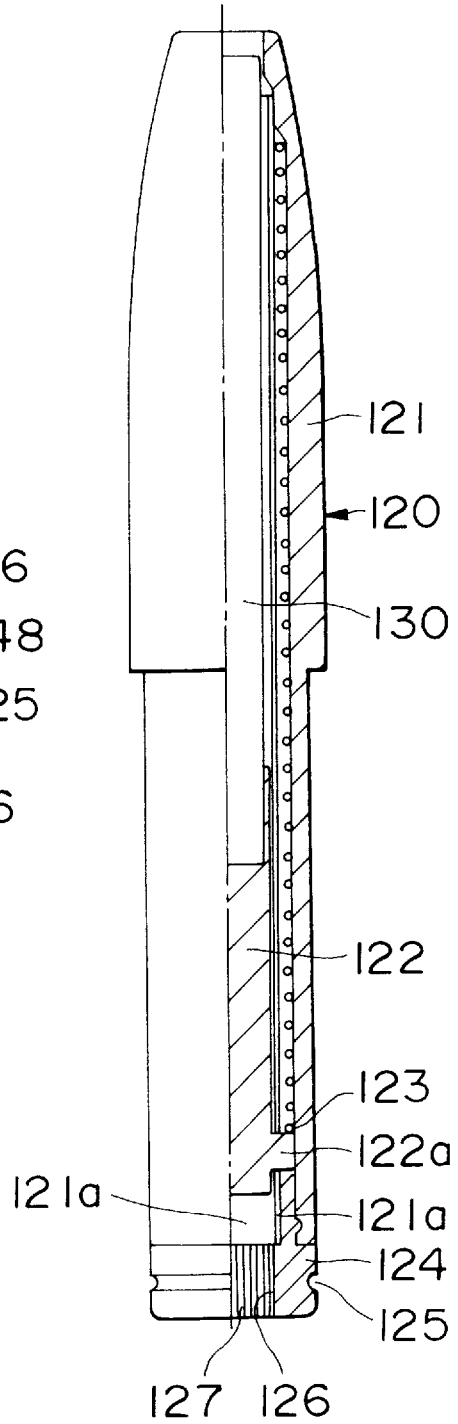
FIG. 20 is a side view of the cartridge C shown in FIG. 14.

The description will now be made as regards the structure of a cartridge 120. Referring to FIG. 20, the cartridge 120 comprises a cartridge body 121 having a tapered cylindrical shape and having a diameter which allows it to be installed into the connecting pipe 147 disposed on the distal end side of the case body 141. A grooved pipe 121*a* is installed into the cartridge body 121, and a core chuck 122 is slidably installed into the grooved pipe 121*a* and has a protrusion 122*a* protruding from a groove 121*b* of the grooved pipe 121*a*. A coil spring 123 is wound around the grooved pipe 121*a* and disposed between the protrusion 22*a* and the distal end of the cartridge body 121. Thereby, the core chuck 122 is urged by the coil spring 123 toward a proximal end side of the cartridge body 121. A stick type solid cosmetic is supported by an end of the core chuck 122. The cartridge body 121 has a rear plug 124 for preventing the core chuck from projecting outside the cartridge body 121 engaged to the proximal end of the cartridge body 121. The rear plug 124 has an annular engaging portion 125 disposed on the periphery of the rear plug 124. The annular engaging portion 125 rotatably engages the engaging gaps 110 disposed on an inner surface of the cartridge supporting pieces 149. The rear plug 124 is provided with a through hole 126 through which the extruding rod 144 passes after installing the cartridge 120 into the case body 141. The through hole 126 has a geared portion 127 to stop a rotation of the extruding rod 144 and to engage the cartridge 120 with the extruding rod 144 so that the cartridge 120 rotates with the extruding rod 144. The geared portion 127 is a groove having a star shape to engage the projections 146.

The extruding rod 126 is inserted into an 0 ring 139 at a portion protruding toward the distal end side from the helical cylinder 143. An inner diameter of the 0 ring 139 is usually smaller than the outer diameter of the extruding rod 126. Therefore, the 0 ring 139 is prevented from dropping out from the extruding rod 126.

A cap 131 is capable of being engaged to the connecting pipe 147 to cover the cartridge 120.

The cartridge 120 is inserted into the distal end of the case body 141 to insert the rear plug 124 into the cartridge supporting pieces 149 integrally formed in an annulation. Then, the engaging gears 110 of the cartridge supporting pieces 149 engage the inside of the annular engaging portion 125. Therefore, the cartridge 120 is installed into the case body 141. In this event, the distal end of the extruding rod 144 is installed into the through hole 126 and the projections 146 engage the geared portion 127.

In this condition, the 0 ring 139 is caught between the helical cylinder 143 and the rear plug 124. Therefore, the movement of the 0 ring 139 is restricted.

In this condition, the extruding rod 144 is rotated with the cartridge 120 with the helical cylinder 143 of the case body 141 by holding the case body 141 and rotating the cartridge 120. The protrusion 145 of the extruding rod 144 is extruded by the helical cylinder 142 and moves forward outside of the case body 141. Therefore, the distal end of the extruding rod 144 extrudes the core chuck 122 disposed in the cartridge body 121 to feed the stick type solid cosmetic 130 supported to the core chuck 122 from the distal end of the cartridge 121. The solid cosmetic 122 is drawn and accommodated in the cartridge body 120 by relative converse rotation contrary to the above feeding.

While the user moves the extruding rod 126 back and forward, slide resistance is applied to the back and forward movement of the extruding rod 126 by the O ring 139. Therefore, it is not capable of overmoving the extruding rod 126 and selfishly retracting the extruding rod 126 toward the proximal end side against the user's will.

The apparatus of the fourth embodiment may be provided with the clutch release portion 16 as in the first embodiment.

According to the fourth embodiment, the cartridge 120 is able to be installed to the cartridge supporting pieces 149 only by inserting the cartridge 120 into the case body 141. Furthermore, the cartridge 120 is detachable from the cartridge supporting pieces 149 only by drawing the cartridge 120. Therefore, the cartridge 120 is easily installed or detached at once.

The cartridge supporting pieces 149 support the rear plug 124 of the cartridge 120 with elasticity of the cartridge supporting pieces 149. The cartridge supporting pieces 149 are prevented from overrotating because of a predetermined operational resistance of its elasticity when the cartridge 120 is rotated. Thus, the stick type solid cosmetic 130 is able to be protruded with a suitable length thereof.

The rear plug 124 of the cartridge 120 has the geared portion 127 which stops the rotation of the extruding rod 144 to rotate both the rear plug 124 and the extruding rod 144, making it possible to decrease the number of parts so as to simplify assembly.

Fifth Embodiment

Figure 21:
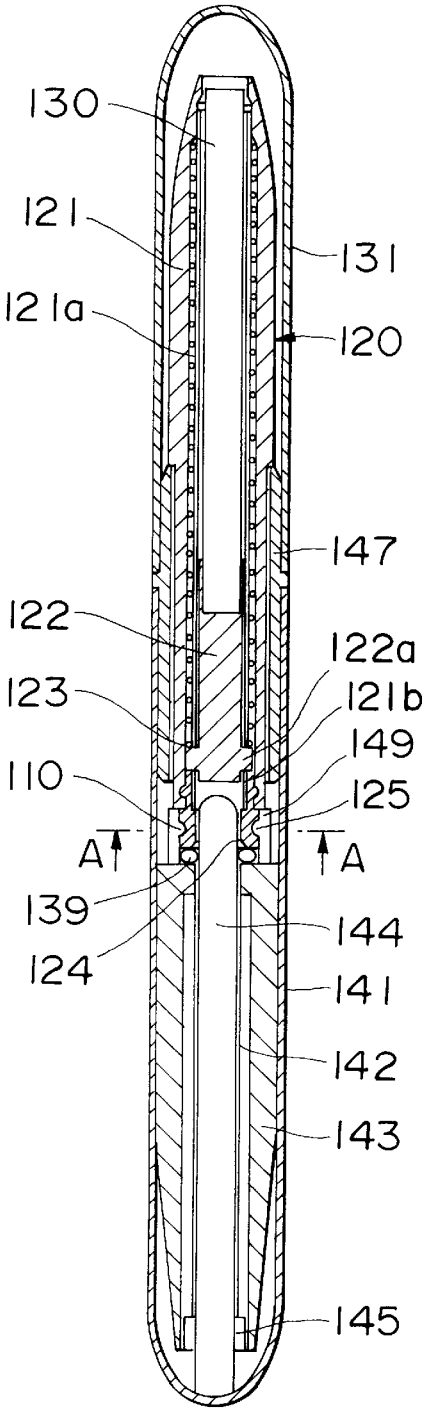
FIG. 21 is a vertical section of a cartridge-type feeding case for feeding a solid object according to a fifth embodiment of the present invention, in which the solid object is installed.
Figure 22:
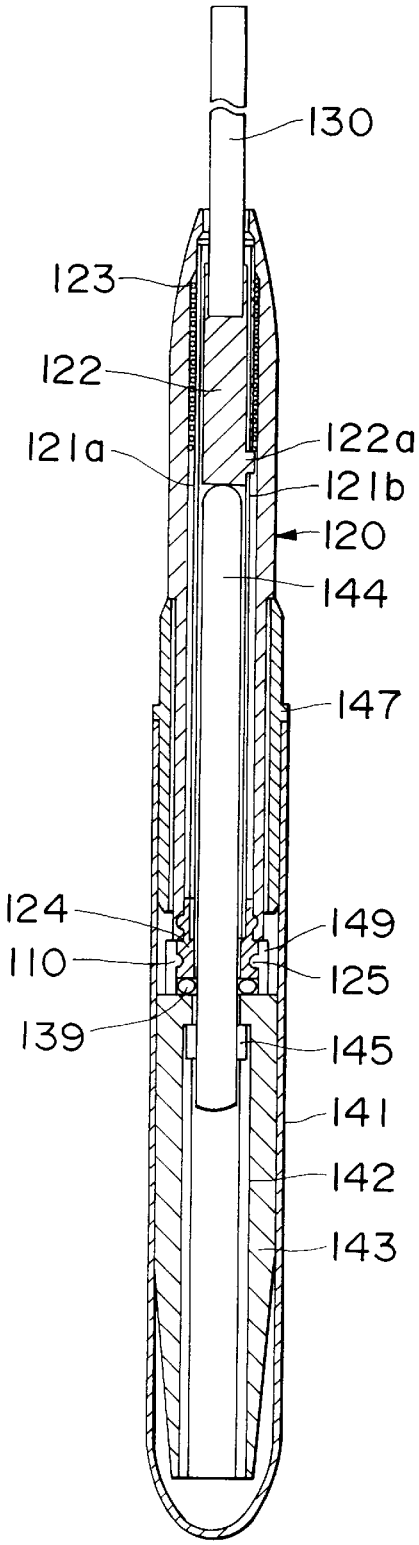
FIG. 22 is a vertical section of a cartridge-type feeding case for feeding a solid object according to the fifth embodiment of the present invention, in which the solid object is projected.
Figure 23:
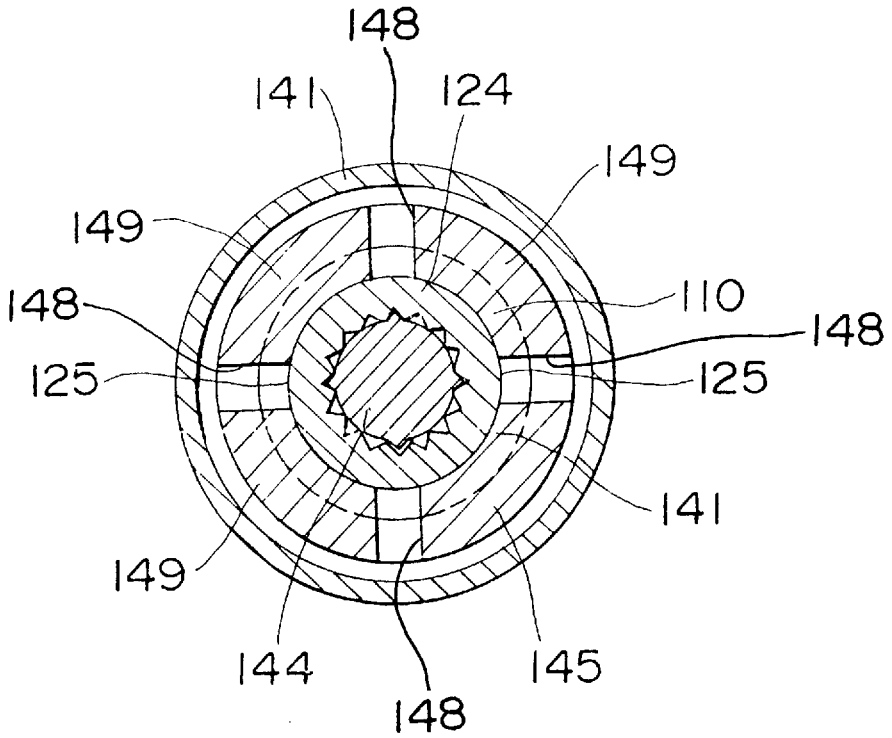
FIG. 23 is a transverse cross section of the cartridge-type feeding case shown in FIG. 21 taken on a line A—A.

As compared with the apparatus according to the fourth embodiment, the apparatus according to a fifth embodiment is characterized in that the cartridge supporting pieces 149 are incorporated with the distal end of the helical cylinder 143 which is not formed to the connecting pipe 147, as shown in FIGS. 21, 22 and 23. The cartridge supporting pieces 149 are formed by providing slits 148 to a cylinder. The other parts of the apparatus of the fifth embodiment are the same as the apparatus of the fourth embodiment.

Sixth Embodiment

Figure 24:
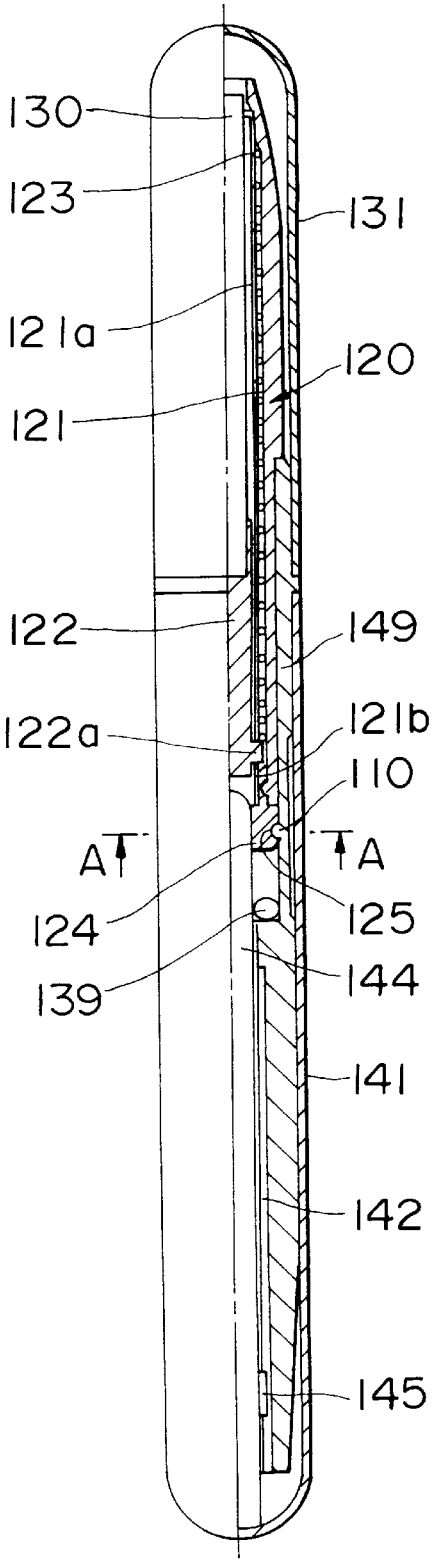
FIG. 24 is a vertical section of a cartridge-type feeding case for feeding a solid object according to a sixth embodiment of the present invention, in which the solid object is installed.
Figure 25:
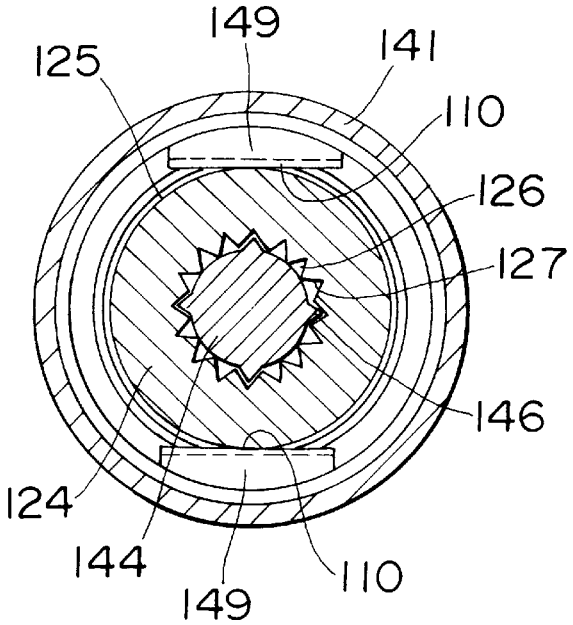
FIG. 25 is a transverse cross section of the cartridge-type feeding case shown in FIG. 24 taken on a line A—A.

As compared with the apparatus according to the fourth embodiment, an apparatus according to a sixth embodiment is characterized by providing a pair of cartridge supporting pieces 149 to the distal end of the helical cylinder 143 without the connecting pipe 147, as shown in FIGS. 24 and 25. Each of the cartridge supporting pieces 149 has a tip end for protruding from the distal end of the case body 141 so that the cartridge supporting pieces 149 also have the same function as the connecting pipe 147. The other parts of the apparatus of the sixth embodiment are the same as the apparatus of the fourth embodiment.

Seventh Embodiment

Figure 26:
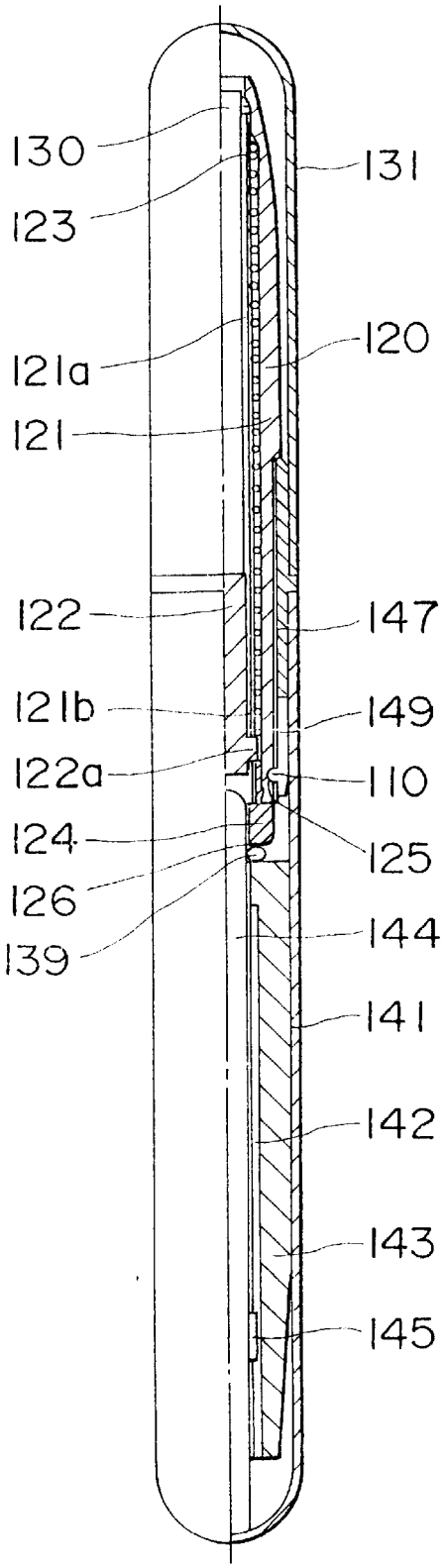
FIG. 26 is a vertical section of a cartridge-type feeding case for feeding a solid object according to a seventh embodiment of the present invention, in which the solid object is installed.
Figure 27:
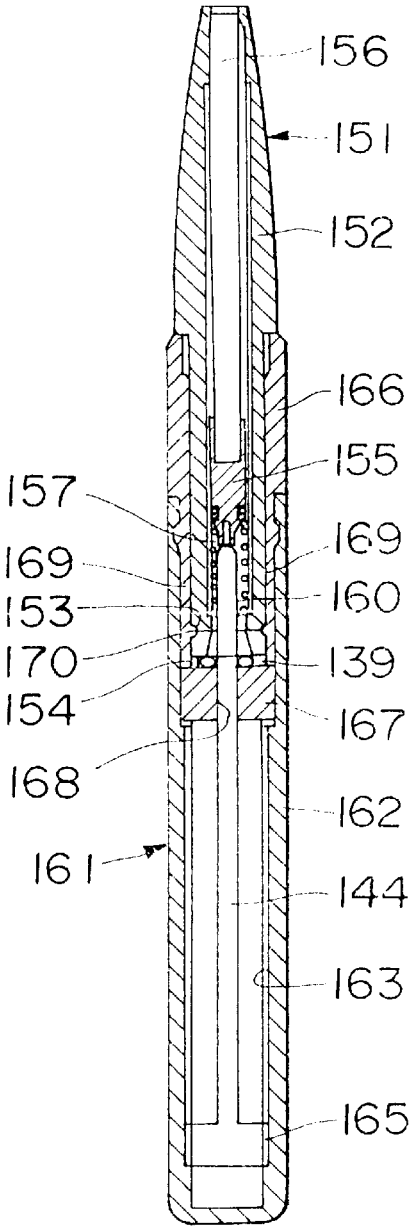
FIG. 27 is a vertical section of a cartridge-type feeding case for feeding a solid object according to a eighth embodiment of the present invention, which that the solid object is installed.
Figure 28:
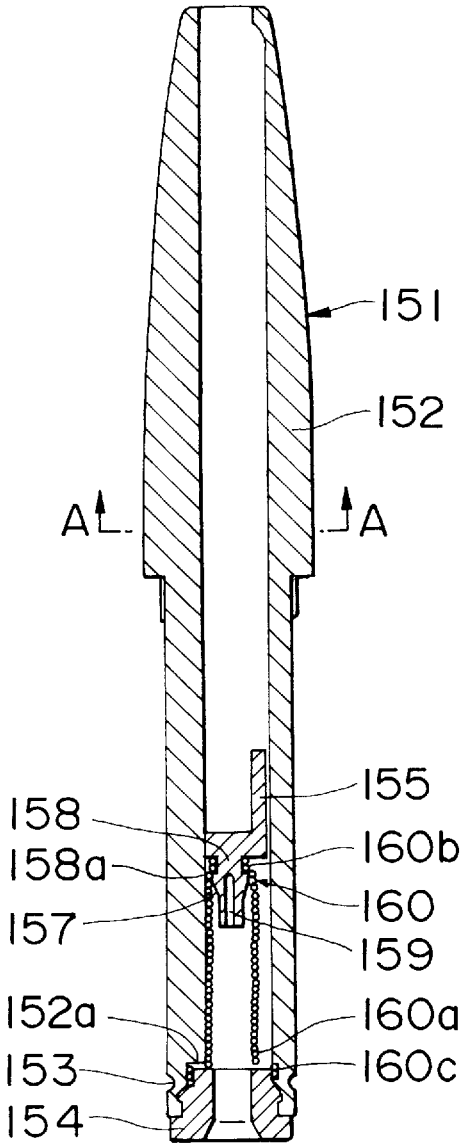
FIG. 28 is a side view of the cartridge C shown in FIG. 27.
Figure 29:
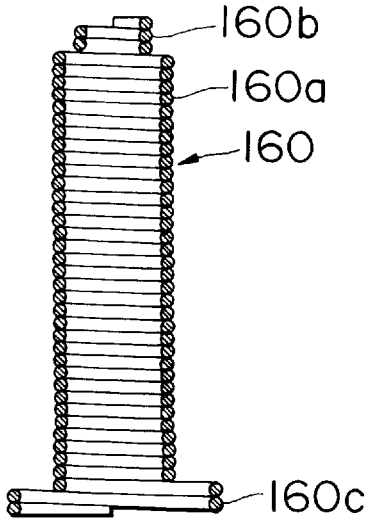
FIG. 29 is a side view of tension spring shown in FIG. 28
Figure 30:
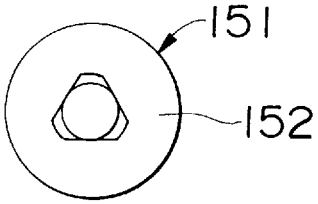
FIG. 30 is a transverse cross section of the cartridge-type feeding case shown in FIG. 28 taken on a line A—A.
Figure 31:
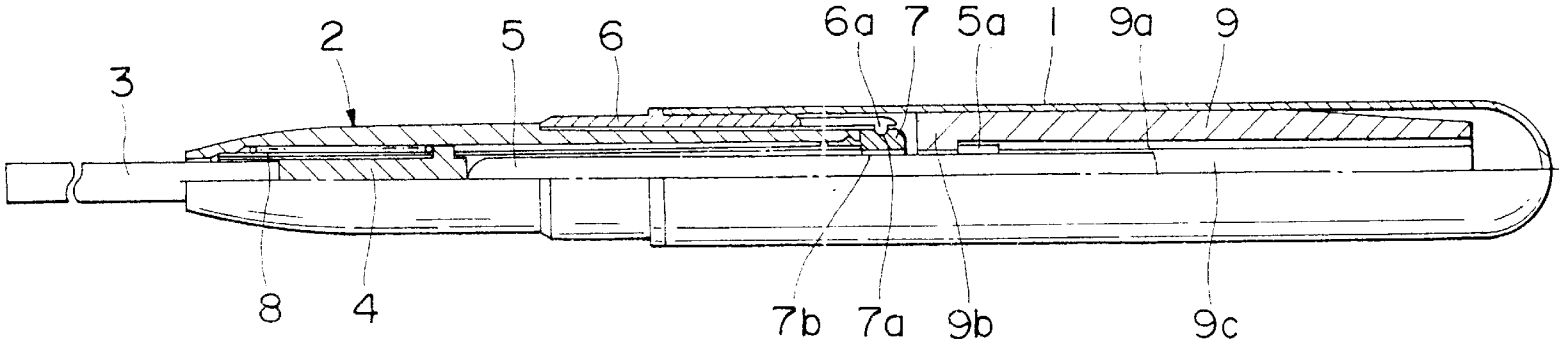
FIG.31 PRIOR ART
FIG. 31 is a vertical section of a conventional cartridge-type feeding case for feeding a solid object.

An apparatus according to a seventh embodiment of the present invention comprises the annular engaging portion 125 (FIG. 26) disposed on the periphery of the proximal end of the cartridge body 121. The annular engaging portion 125 engages the engaging gap 110 of the cartridge supporting pieces 149. The other parts of the apparatus of the seventh embodiment are the same as the apparatus of the fourth embodiment.

Therefore, the rear plug 124 is drawn by the cartridge supporting pieces 149 to prevent the rear plug from falling off from the cartridge body 121 when the cartridge is detached.

Eighth Embodiment

FIGS. 27, 28, 29, and 30 show an apparatus according to an eighth embodiment of the present invention. It is an object of the eighth embodiment to provide a cartridge-type feeding case in which the tension coil spring is easy to install into the cartridge. The rotation of the cartridge is transmitted to the extruding rod 164 through the rotary cylinder 166 as a plug.

FIGS. 27, 28, 29, and 30 show a feeding case according to the eighth embodiment comprising a cartridge 151 and a case body 161 in which the cartridge 151 is installed.

The cartridge 151 has a cylindrical cartridge body 2 having openings at a distal end and at a proximal end thereof, respectively. The cartridge body 152 has an annular groove 153 around a periphery at the proximal end of the cartridge body 152. Furthermore, the opening of the proximal end side of the cartridge body 152 has a large aperture portion to engage a rear plug 154 into which an extruding rod 164 is installed.

A core chuck 155 is slidably disposed in the cartridge body 152. The core chuck 155 supports a proximal end of a stick type solid cosmetic at a distal end of the core chuck 155. The core chuck 155 has a holding protrusion 157 disposed on the proximal end of the core chuck 155. The holding protrusion 157 has a conical shape which is tapered toward the proximal end of the cartridge body 2.

The holding protrusion 157 has a neck portion 158 at a connecting portion between the holding protrusion 157 and the core chuck 155. The neck portion 158 has a spring securing step 158*a*. Furthermore, the holding protrusion 157 is divided by a slit 159 disposed along an axial direction of the cartridge 151. A small diameter part 160*b* formed at one side of the tension spring engages a periphery of the neck portion 158 and the small diameter part 160*b* is secured by contacting with the spring securing step 158*a*.

A large diameter part 160*c* formed at the other side of the tension spring 160 contacts with a step portion 152*a*. The step portion 152*a* is formed by disposing the large aperture portion which engages the rear plug 154 formed at the proximal end of the cartridge body 152. The large diameter part 160*c* of the tension spring 160 is prevented from drawing in the cartridge body 152.

The rear plug 154 is installed into the large aperture portion at the proximal end of the cartridge body 152 to engage the rear plug 154 to the cartridge body 152. A concave groove formed in the large aperture engages an annular convex portion formed in the rear plug 154 to stop the rear plug 154 so that the large diameter part 160*c* of the tension spring 160 is prevented from slipping out of the cartridge body 152 The description will now be made as regards the structure of the case body 161 into which the cartridge is installed.

The case body 161 has an exterior cylinder 162 which is opened at the distal end thereof and is shut at the proximal end thereof. The exterior cylinder 162 has a helicoidal groove 163 disposed on an inner surface of the exterior cylinder 162. The extruding rod 164 is inserted into the exterior cylinder 162. The extruding rod 164 moves back and forward along the axial direction of the exterior cylinder 162 to be capable of taking in and out the extruding rod 164 from the distal end of the exterior cylinder 162. The extruding rod 164 has a triangular section as a non-circular section and a protrusion 165 disposed at the distal end of the extruding rod 164 gearing with the helicoidal groove 163. A rotary cylinder 166 is rotatably disposed on the distal end of the exterior cylinder. A stopper 167 is disposed at the proximal end of the rotary cylinder 166. The stopper 167 passes through the extruding rod 164 to stop the rotation of the extruding rod 164 relative to the rotary cylinder 166. The stopper 167 is provided with a through hole having a triangular shape of a similar non-circular shape as the section of the extruding rod 164 so that the extruding rod 164 is not capable of rotating within the through hole. The rotary cylinder 166 has a slit 169 formed near the stopper 167. The slit 169 has a residual portion having an elasticity. An annular gap 170 disposed on an inner surface of the residual portion engages an annular concave portion 153 disposed on the proximal end of the cartridge so as to prevent the cartridge 151 from slipping out.

The extruding rod 164 is inserted into the O ring 139 at the portion protruding toward the distal end side from the stopper 167. An inner diameter of the O ring 139 is usually smaller than the outer diameter of the extruding rod 164. Therefore, the O ring 139 is prevented from dropping out from the extruding rod 164.

The proximal end of the cartridge 151 is installed into the distal end of the rotary cylinder 166. At the same time, the distal end of the extruding rod 164 passes through a spring body 160*a* of the tension spring 160 to contact the distal end of the extruding rod 164 to the proximal end of the core chuck 155.

In this condition, the O ring 139 is caught between the stopper 167 and the rear plug 154. Therefore the movement of the O ring 139 is restricted.

The description will now be made as regards the operation of the cartridge-type feeding case according to the eighth embodiment.

The cartridge 151 is inserted into the distal end of the rotary cylinder 166. The user, then, rotates the exterior cylinder 162 while holding the rotary cylinder 166, and the rotary cylinder 166 is rotated relative to the exterior cylinder 162. The protrusion 165 is guided to the helicoidal groove 163, so the extruding rod 164 moves toward the direction protruding from the exterior cylinder 162 and the rotary cylinder 166. The core chuck 155 within the cartridge 151 is pushed against the spring force of the tension spring 160, then, the stick type solid cosmetic 156 is protruded from the cartridge 151. The solid cosmetic 156 is drawn and accommodated in the cartridge body 151 by rotating the exterior cylinder 162 contrary to the above feeding.

The holding protrusion 157 disposed on the core chuck 155 has a tapered conical shape. The holding protrusion 157 has a neck portion 158 at the proximal end of the holding protrusion 157 for forming a spring securing step 158*a*. The small diameter part 160*b* formed at one side of the tension spring 160 engages a periphery of the neck portion 158 and the small diameter part 160*b* is secured by contacting the spring securing step 158*a*.

Therefore, the small diameter part 160*b* of the tension spring 160 is easily engaged with the neck portion 158 by the holding protrusion 157 having the conical distal end. The small diameter part 160*b* is surely secured by contacting the spring securing step 158*a*.

A large diameter part 160*c* formed at the other side of the tension spring 160 contacts the step portion 152*a* positioned at the proximal end of the cartridge body 152 to which the rear plug 154 is engaged.

Therefore, the large diameter part 160*c* of the tension spring 160 contacts with the step portion 152*a* only by softly inserting the tension spring 160 installed to the core chuck 155 into the cartridge body 152, whereby the other side of the tension spring 160 is secured, thereby. The rear plug 154 prevents the tension spring 160 from getting out of the cartridge body 152.

While the user moves the extruding rod 164 back and forward, slide resistance is applied to the back and forward movement of the extruding rod 164 by the O ring 139. Therefore, it is capable of preventing from overmoving the extruding rod 164 and retracting the extruding rod 164 toward the proximal end side against the user's will.

The apparatus of the eighth embodiment may be provided with the clutch release portion 16 as the first embodiment.

As described above, according to the present invention, there is provided a cartridge-type feeding case for feeding a solid object comprising resistance means for applying slide resistance force to a periphery of the extruding rod feeding the solid object to provide better operating feeling by applying a certain resistance to the back and forward movement of the solid object by spring force.

According to the present invention, there is provided a cartridge-type feeding case for feeding a solid object comprising a clutch release having a small outer diameter at a proximal end of the extruding rod for feeding the solid object. Therefore, the extruding rod is released from being rotated by the clutch release on complete consumption of the solid object, so that the user can recognize that the solid object is completely consumed. Consequently, the case is protected from damage because overstrain of the feeding rotation is avoided.

According to the present invention, there is provided a cartridge-type feeding case comprising a cartridge removably supported in an exterior cylinder via a plug, which is allowed to rotate relatively in place, and a stopper integrally disposed to a rear end of the plug for defining a back and forward stroke of the extruding rod. Thereby, it is possible to decrease the number of parts so as to simplify the assembly and decrease the number of product steps.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A cartridge-type feeding case for feeding a solid object, comprising:

a cartridge having a through hole for projectably accommodating the solid object;

a case body for removably and rotatably holding the cartridge, said case body having an inner surface on which a female screw thread is formed;

an extruding rod situated in said case body for extruding the solid object through said through hole while the cartridge is installed in said case body, said extruding rod being movable axially backward and forward between a retracted position within said case body and an extended position extending outwardly of said case body, said extruding rod having a male screw thread for engaging said female screw thread whereby relative rotation of one of the extruding rod and the case body causes relative axial motion between said extruding rod and said case body;

stopping means for barring further axial movement of the extruding rod at its extended position;

means for disengaging said male and female threads before said extruding rod reaches its extended position by disengagement of said screw threads immediately before said extruding rod contacts said stopping means;

resistance means for applying slide resistance to backward and forward axial movement of said extruding rod relative to said case body; and means for releasing said resistance means from applying said slide resistance when said extruding rod reaches a position immediately before the end of its forward movement.

2. A cartridge-type feeding case for feeding a solid object as claimed in claim 1, wherein said extruding rod is movably inserted into said through hole of said cartridge.

3. A cartridge-type feeding case for feeding a solid object as claimed in claim 2, further comprising:

a retainer incorporated into said through hole of said cartridge for retaining the solid object, said retainer being allowed to move backward and forward in said through hole; and urging means for constantly urging said retainer axially inward into said cartridge.

4. A cartridge-type feeding case for feeding solid object as claimed in claim 2, further comprising:

rotation transmitting means for transmitting the rotation of said cartridge to said extruding rod and thus for moving said extruding rod along an axis direction thereof by the rotation of said extruding rod.

5. A cartridge-type feeding case for feeding a solid object as claimed in claim 4, wherein said rotation transmitting means comprises said through hole of said cartridge and said extruding rod inserted in said through hole, wherein the sectional form of said through hole and the sectional form of said extruding rod are configured and arranged for allowing mutual axial displacement in said axial direction therebetween and for preventing mutual rotation therebetween.

6. A cartridge-type feeding case for feeding a solid object as claimed in claim 5, wherein the sectional form of said through hole and the sectional form of said extruding rod each have a non-circular shape.

7. A cartridge-type feeding case for feeding a solid object as claimed in claim 6, wherein the sectional form of said through hole and the sectional form of said extruding rod are both of a similar shape.

8. A cartridge-type feeding case for feeding a solid object as claimed in claim 4, wherein said case body has an opening; and further comprising:

a plug rotatably disposed in said opening of said case body, said plug comprising a large diameter cylindrical part for holding said cartridge and a small diameter part disposed on a proximal end of said plug having a through hole passing through said extruding rod;

said rotation transmitting means comprising said through hole of said plug and said extruding rod inserted into said through hole, said through hole and said extruding rod each respectively having a section configured and arranged for allowing mutual displacement along the axial direction and for preventing mutual rotation therebetween.

9. A cartridge-type feeding case for feeding a solid object as claimed in claim 1, further comprising a plug disposed at an end opening of said case body, said plug having an opening for rotatably and removably holding said cartridge.

10. A cartridge-type feeding case for feeding a solid object as claimed in claim 9, wherein said cartridge has a cylindrical inserting part to be inserted into said opening of said plug.

11. A cartridge-type feeding case for feeding a solid object as claimed in claim 10, wherein one of an inner surface of said opening of said plug and an outer surface of said cylindrical inserting part of said cartridge has a circumferential groove, and the other of them has a circumferential protrusion capable of engaging said circumferential groove.

12. A cartridge-type feeding case for feeding a solid object as claimed in claim 11, therein said cartridge has a cartridge plug having a through hole disposed on the proximal end of said cartridge for passing through said extruding rod, said circumferential groove being formed around the periphery of said cartridge plug.

13. A cartridge-type feeding case for feeding a solid object as claimed in claim 10, wherein said stopping means and said plug are integrally formed.

14. A cartridge-type feeding case for feeding a solid object as claimed in claim 13, wherein said extruding rod comprises a shaft having axially spaced small diameter and large diameter parts, said large diameter part being formed coaxially with said shaft, said stopping means having a through hole having an inner diameter, said inner diameter having magnitude that allows said small diameter part of said extruding rod to be rotatably inserted therethrough and bars said large diameter part of said extruding rod from being inserted therethrough.

15. A cartridge-type feeding case for feeding a solid object as claimed in claim 14, wherein said shaft has a portion which is passed through said stopping means.

16. A cartridge-type feeding case for feeding a solid object as claimed in claim 1, wherein said resistance means is an elastic ring encircling said extruding rod at a site along the length thereof.

17. A cartridge-type feeding case for feeding a solid object as claimed in claim 16, further comprising positioning means for preventing said elastic ring from moving within said case body.

18. A cartridge-type feeding case for feeding a solid object as claimed in claim 16, wherein said means for releasing said resistance means from applying said slide resistance comprises a small diameter clutch release portion on a proximal end of said extruding rod.

19. A cartridge-type feeding case for feeding a solid object including a cartridge for projectably accommodating the solid object into an internal through hole thereof and a case body having an opening for removably and rotatably holding the cartridge, comprising:

an extruding rod incorporated in said case body for extruding the solid object when the cartridge is installed in said case body, said extruding rod being allowed to move backward and forward in said case body between a retracted position and an extended position;

converting means for converting rotation movement of said cartridge relative to said case body into axial sliding movement of said extruding rod relative to said case body;

canceling means for canceling the movement by said converting means when the extruding rod is at said extended position;

stopping means for barring further axial movement of the extruding rod when it is at its extended position;

means for providing a resistance to said rotation; and means for reducing said resistance when said extruding rod is moved to said extended position.

20. A cartridge-type feeding case for feeding a solid object comprising:

a cylindrical case body having a bore surface including thereon a helical concave groove having a shape of a female screw thread;

a cartridge being removably supported in said bore of said cylindrical case body for retracting said solid object into said cylindrical case body;

an extruding rod movable backward and forward axially between a retracted position and an extended position, and including a protruding portion having a shape of a male screw thread for engaging the helical concave groove in said cylindrical case body, said cylindrical case body having a bore having a diameter greater than the outer diameter of said protruding portion of said extruding rod which is loosely accommodated in said bore, said extruding rod extruding said solid object by pushing into said cartridge, said cartridge having a rear end in which said extruding rod is inserted, the rear end of said cartridge having a shape that is capable of applying rotation to said extruding rod and liner movement axially along a backward and forward direction, said cylindrical case body and said cartridge relatively rotating for producing a rotation, said extruding rod moving backward and forward axially by said rotation and an elastic ring being contactably inserted onto a periphery of said extruding rod in a position contacting said rear end of said cartridge, said extruding rod having a proximal end, said proximal end including a small diameter clutch release portion to release slide contact between said elastic ring and said extruding rod, and stopping means for barring further axial movement of the extruding rod when the extruding rod is at its extended position, so that a user can recognize that the solid object is consumed, and whereby the case is protected from damage caused by overstrain of the feeding operation.

21. A cartridge-type feeding case for feeding a solid object, comprising:

a cartridge having a through hole for projectably accommodating the solid object;

a case body for removably and rotatably holding said cartridge;

an extruding rod incorporated in said case body for extruding the solid object from said through hole when said cartridge is installed in said case body, said extruding rod being movable backward and forward in said case body between a retracted position and an extended position;

converting means for converting rotation movement of said cartridge relative to said case body into relative backward and forward movement of said extruding rod relative to said case body;

resistance means for applying slide resistance to said relative backward and forward movement of said extruding rod relative to said case body, means for releasing said resistance means from applying said slide resistance when said extruding rod reaches a position immediately before the end of its forward movement, and stopping means for barring further axial movement of said extruding rod when it is at its extended position.

22. A cartridge-type feeding case for feeding a solid object as claimed in claim 21, wherein said resistance means is an elastic ring encircling said extruding rod at a site along the length thereof.

23. A cartridge-type feeding case for feeding a solid object as claimed in claim 22, further comprising positioning means to prevent said elastic ring from moving axially within said case body.

24. A cartridge-type feeding case for feeding a solid object as claimed in claim 22, wherein said extruding rod has two axially spaced outer diameters, one being larger than the inner diameter of said elastic ring for receiving predetermined sliding resistance applied by said elastic ring and the other being smaller than the inner diameter of said elastic ring for traversing said ring without receiving predetermined sliding resistance from said elastic ring.

25. A cartridge-type feeding case for feeding a solid object comprising a cartridge for projectably accommodating the solid object into an internal through hole thereof and a case body having an opening for removably and rotatably holding the cartridge, comprising:

an extruding rod incorporated in said case body for extruding the solid object when the cartridge is installed in said case body, said extruding rod being movable axially backward and forward between a retracted position within said case body and an extended position extending outwardly of said case body;

converting means for converting rotation movement of said cartridge relative to said case body into an axial sliding movement of said extruding rod relative to said case body;

means for providing a resistance to said rotation, and means for reducing said resistance when said extruding rod is moved to said extended position.

26. A cartridge-type feeding case for feeding a solid object comprising:

a cylindrical case body having a bore surface including thereon a helical concave groove having a shape of a female screw thread;

a cartridge being removably supported in said bore of said cylindrical case body for retracting the solid object into said case body;

an extruding rod movable backward and forward and including a radially protruding portion having a shape of a male screw thread for engaging said female screw thread in said cylindrical case body, said cartridge having a rear end in which said extruding rod is inserted for extruding the solid object, said rear end of said cartridge having a shape that is capable of applying rotation to said extruding rod and linear movement axially along a backward and forward direction, said cylindrical case body and said cartridge relatively rotating for producing a rotation, said extruding rod moving backward and forward axially by said rotation; and an elastic ring situated on a periphery of said extruding rod, said elastic ring contacting and causing sliding resistance upon said extruding rod, said extruding rod having a proximal end, said proximal end having a smaller diameter than an inner diameter of said elastic ring, whereby upon axial movement of said proximal end into said elastic ring, said extruding rod is released from sliding resistance contact with said elastic ring.

* * * * *

UNITED STATES PATENT AND TRADEMARK OFFICE

CERTIFICATE OF CORRECTION

PATENT NO. : 5,836,708
DATED : November 17, 1998
INVENTOR(S) : Tani

It is certified that error appears in the above-identified patent and that said Letters Patent is hereby corrected as shown below:

Column 1, line 20, after "inventor" insert --.-- (period)

Column 2, lines 47-48, delete "remainder protruded necessarily" and insert --protruded remainder-- therefor Column 2, line 48, delete "necessarily" (second occurrence)

Column 2, line 63, delete "following"

Column 3, line 37, delete "brakes" and insert --breaks-- therefor

UNITED STATES PATENT AND TRADEMARK OFFICE

CERTIFICATE OF CORRECTION

PATENT NO. : 5,836,708
DATED : November 17, 1998
INVENTOR(S) : Tani

It is certified that error appears in the above-identified patent and that said Letters Patent is hereby corrected as shown below:

Column 3, line 55, delete "feed" and insert --feel-- therefor

Column 6, line 2, after "D." begin a new paragraph

Column 6, line 40, delete "that"

Column 8, line 18, after "annular" delete ","

(comma)

Column 10, line 12, delete "of." and insert --of-- therefor

Column 16, line 48, delete "0" and insert --0-- therefor

UNITED STATES PATENT AND TRADEMARK OFFICE

CERTIFICATE OF CORRECTION

PATENT NO. : 5,836,708
DATED : November 17, 1998
INVENTOR(S) : Tani

It is certified that error appears in the above-identified patent and that said Letters Patent is hereby corrected as shown below:

Column 16, line 50, delete "0" and insert --0-- therefor

Column 16, line 52, delete "0" and insert --0-- therefor

Column 16, line 65, delete "0" and insert --0-- therefor

Column 16, line 67, delete "0" and insert --0-- therefor

UNITED STATES PATENT AND TRADEMARK OFFICE

CERTIFICATE OF CORRECTION

PATENT NO. : 5,836,708
DATED : November 17, 1998
INVENTOR(S) : Tani

It is certified that error appears in the above-indentified patent and that said Letters Patent is hereby corrected as shown below:

Column 18, line 61, after "152". begin a new paragraph

Signed and Sealed this

Thirtieth Day of November, 1999

*Attest:*

Q. TODD DICKINSON

*Attesting Officer*

*Acting Commissioner of Patents and Trademarks*